US012168879B2

(12) United States Patent
Metzger

(10) Patent No.: US 12,168,879 B2
(45) Date of Patent: Dec. 17, 2024

(54) FIELD-ASSEMBLED WALL AND FLOORING SYSTEMS

(71) Applicant: James R. Metzger, Santa Ana, CA (US)

(72) Inventor: James R. Metzger, Santa Ana, CA (US)

( * ) Notice: Subject to any disclaimer, the term of this patent is extended or adjusted under 35 U.S.C. 154(b) by 0 days.

(21) Appl. No.: 18/396,651

(22) Filed: Dec. 26, 2023

(65) Prior Publication Data

US 2024/0247501 A1 Jul. 25, 2024

Related U.S. Application Data

(63) Continuation of application No. 18/112,485, filed on Feb. 21, 2023, now Pat. No. 11,851,893, which is a continuation of application No. 17/590,713, filed on Feb. 1, 2022, now Pat. No. 11,585,101, which is a continuation of application No. 16/883,934, filed on May 26, 2020, now Pat. No. 11,236,516, which is a continuation of application No. 16/269,556, filed on Feb. 6, 2019, now Pat. No. 10,662,657.

(60) Provisional application No. 62/627,154, filed on Feb. 6, 2018.

(51) Int. Cl.

| | |
|---|---|
| ***E04F 15/20*** | (2006.01) |
| ***E04B 1/82*** | (2006.01) |
| ***E04B 1/86*** | (2006.01) |
| ***E04B 1/94*** | (2006.01) |
| ***E04F 15/18*** | (2006.01) |

(52) U.S. Cl.
CPC ..... *E04F 15/203* (2013.01); *E04B 1/82* (2013.01); *E04B 1/86* (2013.01); *E04F 15/182* (2013.01); *E04B 1/942* (2013.01)

(58) Field of Classification Search
CPC ..... E04F 15/203; E04F 15/182; E04F 15/142; E04B 1/86; E04B 1/82; E04B 1/942
See application file for complete search history.

(56) References Cited

U.S. PATENT DOCUMENTS

| | | | | |
|---|---|---|---|---|
| 3,675,384 A * | 7/1972 | Knecht | ..... | E04F 15/02188 4/612 |
| 5,103,602 A * | 4/1992 | Stevens | ..... | A47K 3/001 4/595 |
| 5,845,347 A * | 12/1998 | Young | ..... | A47K 3/008 4/613 |
| 7,096,630 B1 * | 8/2006 | Keene | ..... | E04F 15/20 52/302.1 |

(Continued)

*Primary Examiner* — Rodney Mintz
(74) *Attorney, Agent, or Firm* — Chang & Hale LLP

(57) ABSTRACT

Described herein are methods for installing field-assembled flooring systems wherein the underlayment is a hybrid design that includes a combination of structural board and cementitious product. The hybrid design is configured to reduce or eliminate the curing time requirement after pouring the cementitious product (e.g., gypsum concrete). The field-assembled flooring systems can reduce or eliminate the chances of the onset of mold due to high moisture levels by removing the cementitious product from the prone areas and replacing it with structural boards. The structural boards (e.g., cellulose fiberboards) can be installed in non-critical areas such as underneath cabinets, around the perimeter of the floor, under bathtubs, in non-walk-in closets, anywhere drywall reaches the floor, or the like.

22 Claims, 36 Drawing Sheets

(56) References Cited

U.S. PATENT DOCUMENTS 7,908,810 B2 * 3/2011 Payne, Jr. ..... E04B 5/10 52/480
8,590,268 B2 * 11/2013 Giles ..... E04F 15/12 52/749.11
8,789,316 B2 * 7/2014 Cook ..... E04B 1/68 52/62
9,107,545 B1 * 8/2015 Herring ..... A47K 3/40
10,267,033 B2 * 4/2019 Garcia ..... B29C 66/727
10,465,381 B2 * 11/2019 Garcia ..... B29C 44/326
10,655,343 B2 * 5/2020 Metzger ..... E04F 15/203
10,662,657 B2 * 5/2020 Metzger ..... E04B 1/82
11,060,300 B2 * 7/2021 Wedi ..... E04F 15/182
11,131,101 B2 * 9/2021 Metzger ..... E04B 1/942
11,236,515 B2 * 2/2022 Metzger ..... E04F 15/142
11,236,516 B2 * 2/2022 Metzger ..... E04F 15/142
11,585,101 B2 * 2/2023 Metzger ..... E04B 1/82
11,649,644 B2 * 5/2023 Metzger ..... E04F 15/203 52/506.05
11,680,416 B2 * 6/2023 Metzger ..... E04B 1/86 52/506.05
11,851,893 B2 * 12/2023 Metzger ..... E04B 1/82
11,959,287 B2 * 4/2024 Metzger ..... E04F 15/203
2007/0000198 A1 * 1/2007 Payne, Jr. ..... E04B 5/40 52/414
2008/0233358 A1 * 9/2008 Garcia ..... E04F 15/18 156/60
2010/0126110 A1 * 5/2010 Giles ..... E04F 15/12 52/745.05
2010/0281612 A1 * 11/2010 Cook ..... A47K 3/008 52/302.6
2014/0272320 A1 * 9/2014 Garcia ..... B32B 27/065 156/185
2016/0069068 A1 * 3/2016 Garcia ..... B29C 66/73113 428/189
2019/0218796 A1 * 7/2019 Mazzarino ..... E04F 15/142
2019/0242140 A1 * 8/2019 Metzger ..... E04B 1/86
2019/0352917 A1 * 11/2019 Metzger ..... E04B 1/942
2020/0141128 A1 * 5/2020 Wedi ..... E04F 15/087
2020/0248463 A1 * 8/2020 Metzger ..... E04F 15/142
2020/0277797 A1 * 9/2020 Metzger ..... E04F 15/203
2020/0354973 A1 * 11/2020 Metzger ..... E04F 15/142
2022/0090396 A1 * 3/2022 Metzger ..... E04B 1/86
2022/0228374 A1 * 7/2022 Metzger ..... E04F 15/142
2022/0251855 A1 * 8/2022 Metzger ..... E04F 15/142
2023/0279673 A1 * 9/2023 Metzger ..... E04B 1/86 52/506.05
2023/0366215 A1 * 11/2023 Metzger ..... E04B 1/942

* cited by examiner

FIELD-ASSEMBLED WALL AND FLOORING SYSTEMS

CROSS-REFERENCE TO RELATED APPLICATIONS

This application is a continuation of U.S. application Ser. No. 18/112,485 filed Feb. 21, 2023 and entitled "FIELD-ASSEMBLED WALL AND FLOORING SYSTEMS," which is a continuation of U.S. application Ser. No. 17/590,713 filed Feb. 1, 2022 and entitled "FIELD-ASSEMBLED FLOORING SYSTEMS" (now U.S. Pat. No. 11,585,101 issued Feb. 21, 2023), which is a continuation of U.S. application Ser. No. 16/883,934 filed May 26, 2020 and entitled "MOLD-RESISTANT FIELD-ASSEMBLED FLOORING SYSTEMS" (now U.S. Pat. No. 11,236,516 issued Feb. 1, 2022), which is a continuation of U.S. application Ser. No. 16/269,556 filed Feb. 6, 2019 and entitled "FIELD-ASSEMBLED FLOORING SYSTEMS" (now U.S. Pat. No. 10,662,657 issued May 26, 2020), which claims priority to U.S. Prov. App. No. 62/627,154 filed Feb. 6, 2018 and entitled "FIELD-ASSEMBLED FIRE RATED FLOORING SYSTEMS," each of which is expressly incorporated by reference herein in its entirety for all purposes.

BACKGROUND

Field

The present disclosure generally relates to flooring systems and, in particular, to field-assembled floor underlayments.

Description of Related Art

Flooring systems come in a wide variety of different configurations depending upon the type of building in which they are employed and their intended use. Flooring systems generally include a finish flooring and a subfloor and can include an intermediate layer called an underlayment. Finish flooring is generally the uppermost layer of the flooring system. Known finish flooring materials include wood flooring and resilient flooring. Resilient flooring comprises linoleum, asphalt tiles, vinyl or rubber tiles and the like. The subfloor is typically the structure of the building which supports the remainder of the floor system. Some subfloor materials include wood, such as plywood, or reinforced concrete. Flooring systems, especially those including reinforced-concrete subfloors, may additionally include a vapor barrier and/or acoustic- or fire-rated materials in the underlayment.

SUMMARY

According to a number of implementations, the present disclosure relates to a method for installing a hybrid underlayment having a combination of structural boards and a cementitious product. The method includes applying adhesive to adhere an isolation board to a subfloor in a targeted area, the targeted area lying within a first portion of the subfloor. The method also includes installing the isolation board to the subfloor with the adhesive in the targeted area so that there is a gap between adjacent isolation boards and walls. The method also includes applying adhesive to adhere a bottom side of a structural board to a top side of the installed isolation board. The method also includes installing the structural board on top of the installed isolation board.

The method also includes pouring cementitious product in a second portion of the subfloor so that the poured cementitious product is level with a top side of the structural board. A combination of the isolation board and structural board provide a pour stop for the cementitious product.

In some embodiments, the method further includes fastening the isolation board in place with nails. In some embodiments, the method further includes fastening the structural board in place with nails.

In some embodiments, the first portion and the second portion cover the entire subfloor. In some embodiments, the isolation board comprises a fire-rated cellulose fiberboard. In some embodiments, the structural board comprises a fire-rated cellulose fiberboard In some embodiments, a thickness of a combination of the installed isolation board and the installed structural board is greater than or equal to 1 inch and less than or equal to 2 inches. In some embodiments, the cementitious product comprises gypsum concrete. In some embodiments, a width of the isolation board is less than or equal to 96 inches. In some embodiments, a width of the isolation board is less than or equal to 6 inches and greater than or equal to 4 inches.

According to a number of implementations, the present disclosure relates to a flooring system having a hybrid underlayment. The flooring system includes an isolation board adhered to a first portion of a subfloor. The flooring system also includes a structural board adhered to the isolation board, the structural board having a thickness so that a combined thickness of the isolation board and the structural board is a targeted thickness. The flooring system also includes a cementitious product poured on a second portion of the subfloor, the cementitious product poured to have a thickness that is equal to the targeted thickness. A combination of the isolation board and the structural board serves as a pour stop for the cementitious product.

In some embodiments, the first portion of the subfloor does not extend beyond a footprint of a bathtub in a finished building. In some embodiments, the first portion of the subfloor is situated in a dead space of a finished building. In some embodiments, the first portion of the subfloor is restricted to a floor of a closet of a finished building. In some embodiments, the first portion of the subfloor does not extend more than 12 inches from a wall of a finished building. In some embodiments, the first portion of the subfloor does not extend beyond a footprint of a kitchen island in a finished building. In some embodiments, the combined thickness is greater than or equal to 1 inch and less than or equal to 2 inches. In some embodiments, the cementitious product comprises gypsum concrete. In some embodiments, the isolation board comprises fire-rated cellulose fiberboard. In some embodiments, the structural board comprises fire-rated cellulose fiberboard.

For purposes of summarizing the disclosure, certain aspects, advantages and novel features have been described herein. It is to be understood that not necessarily all such advantages may be achieved in accordance with any particular embodiment. Thus, the disclosed embodiments may be carried out in a manner that achieves or optimizes one advantage or group of advantages as taught herein without necessarily achieving other advantages as may be taught or suggested herein.

BRIEF DESCRIPTION OF THE DRAWINGS

Various embodiments are depicted in the accompanying drawings for illustrative purposes and should in no way be interpreted as limiting the scope of the inventions. In addition, various features of different disclosed embodiments can be combined to form additional embodiments, which are part of this disclosure. Throughout the drawings, reference numbers may be reused to indicate correspondence between reference elements. The drawings are not necessarily to scale so unless otherwise indicated no relative or absolute dimensions should be inferred from the following figures.

FIGS. 2A, 2B, 20, 2D, 2E, and 2F illustrate another example installation of an underlayment layer of flooring using fiber boards for a perimeter board binder.

DETAILED DESCRIPTION OF SOME EMBODIMENTS

Figure 1A:
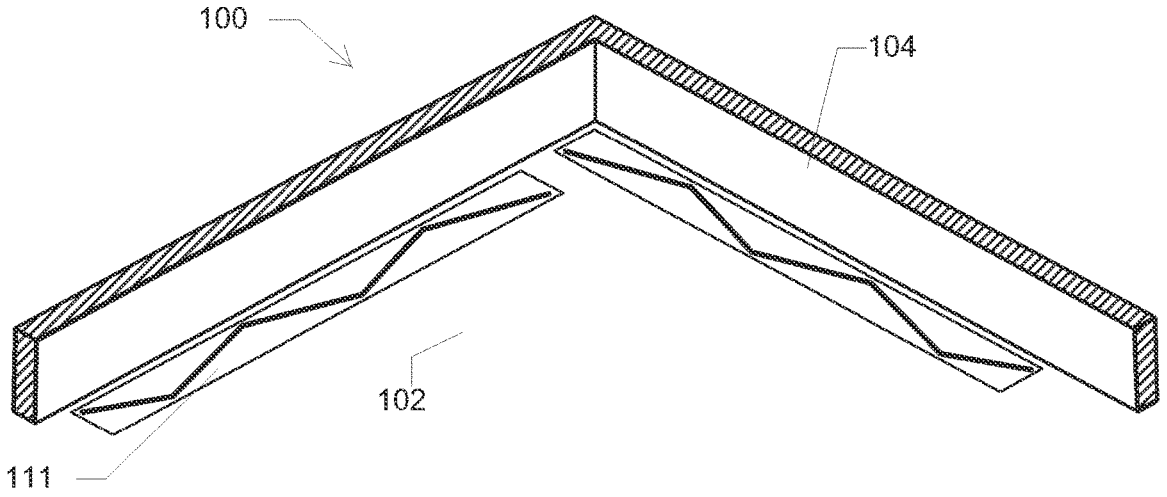
FIGS. 1A, 1B, 1C, 1D, 1E, 1F, and 1G illustrate installation of an underlayment layer of flooring using fiber boards for an inside corner binder.

The headings provided herein, if any, are for convenience only and do not necessarily affect the scope or meaning of the claimed invention.

Overview

Flooring in buildings such as dwellings typically include a subfloor, an underlayment, and a finish floor or floor covering. The topmost layer is the finish floor which is the visible and exposed part of the floor. This layer is not required to provide structural support, but often provides a type of supplementary support. The bottom-most layer is the subfloor. The subfloor is the thick flat surface on which all other layers rest. The subfloor may rest on joists, the foundation, or other structure, or in the case of a concrete slab, the slab may be considered the subfloor.

Underlayment is a layer that sits between the subfloor and the finish floor. The underlayment can facilitate the laying of floor coverings, for example, carpet, tile, wood parquet, and vinyl, and may result in a more stable finished floor. The underlayment may also have sound reduction properties. This is particularly significant where the maximum allowable level of sound transmission is controlled by local building codes, which is increasingly common. For example, underlayment can be used to reduce the transmission of sound through the floor to a room below in a multi-floor building. Underlayment may typically be a cementitious product, such as gypsum concrete, or cellulose fiberboards. Many pourable floor topping mixtures, which are suitable for incorporation in underlayment systems, are gypsum-based, in order to provide a level of fire protection by retarding the spread of flames. An example of gypsum-based floor topping mixtures is GYP-CRETE®, which is available from MAXXON® Corporation. Gypsum-based pourable floor topping are generally installed in dwellings, which are under construction and subject to building codes that require minimum fire ratings.

Cementitious underlayment products have some sound reduction properties; however, the use of cementitious underlayment products and other similar products pose significant challenges for builders. One significant issue is that such products are applied as a wet product (e.g., poured as a thick fluid onto a subfloor) into an otherwise dry environment (e.g., a wood framed building). When such a wet product is applied to a dry environment, the moisture can adversely affect the building process. Issues such as warping of wooden elements, splashing onto unintended surfaces, etc. are common. Furthermore, introducing moisture into any environment increases the chances of mold growth in the environment, which is always an unwanted condition. Another issue is that the application of any wet product typically requires a drying, curing, or setting period following the pouring or application of the wet product. Such periods can cause delays in construction and complicate the planning and project management between various contractors and workers.

Pourable floor toppings are typically installed in two stages: first, over the portions of a dwelling subfloor where fixtures such as bath tubs are to be installed (these portions being designated as pre-pour areas); and, then, over the remainder of the subfloor, following the installation of the fixtures. Although the pre-pour areas are relatively small compared to the remainder of the subfloor, installation of the pourable floor topping to the pre-pour areas requires dispatching to the construction site all of the necessary equipment and crew that, subsequently, must be dispatched again, after installing the bathtubs and other such fixtures, to install the remainder of the floor topping to complete the underlayment system.

Underlayments that use structural boards, such as fiberboards, in place of cementitious products also present difficulties. For example, structural boards typically do not pass acoustical rating requirements for buildings in certain geographical locations. In addition, fiberboards may be more difficult to install finish flooring on top.

Accordingly, to address these and other challenges and to satisfy demands in the marketplace, described herein are methods for installing field-assembled flooring systems wherein the underlayment is a hybrid design that includes a combination of structural board and cementitious product. The hybrid design is configured to reduce or eliminate the curing time requirement after pouring the cementitious product (e.g., gypsum concrete). In some embodiments, the field-assembled flooring systems can reduce or eliminate the chances of the onset of mold due to high moisture levels by removing the cementitious product from the prone areas and replacing it with structural boards. Similarly, the disclosed installation methods may reduce construction time and cost by enabling a single pour for the cementitious product rather than two pouring stages, as is the case in some construction projects. The structural boards (e.g., fiberboards) can be installed in non-critical areas such as, for example and without limitation, underneath cabinets, around the perimeter of the floor, under bathtubs, in non-walk-in closets, anywhere drywall reaches the floor, or the like.

The disclosed methods include the use of structural panels or boards, an adhesive, and ring shank coil nails. In some embodiments, the structural panels or boards can be a cellulose fiber structural panel. For example, the cellulose fiber structural panel can be molded out of paper or other wood products (e.g., recycled post-consumer paper) with a thickness of about 0.75 inches with a density of about 26-28 lbs. per cubic foot. These are merely example values and fiberboards with other densities and thicknesses may be used. An example of such a board is manufactured by HOMASOTE® Company called the 440 SOUNDBARRIER®. This panel can be milled to be a targeted size (e.g., 6 in.×96 in.). Multiple boards can be installed on top of each other to achieve a targeted thickness (e.g., about 1.25 in., about 1.5 in., etc.). The adhesive can have a base that is a synthetic rubber with polymer resins. Typically, such adhesives can have a full cure time of about 2 to 5 days. The adhesive can be applied in a designated or targeted pattern to adhere a first layer to the subfloor and to adhere a second layer to the first layer. Additional layers may also be installed in a similar fashion. Ring shank coil nails can be installed using an offset pattern on the first layer prior to placement of the adhesive to secure the second panel layer. Installation of these nails can be used to secure the first layer in place on the subfloor. Similarly, after the second layer has been secured to the first layer using the adhesive, additional nails can be used in a reverse offset pattern to secure the second layer in place while the adhesives dry and cure. The nails can be placed to create even distribution of the fasteners. For example, the fasteners can be about 8 in. on center. By applying two or more layers of the milled structural panels or boards with a ⅛" gap between panel edges and walls, the sound and fire rating of the hybrid system is improved relative to a unitary system of just structural panels or just cementitious products.

The structural panels or boards can be strategically placed during construction to achieve targeted performance characteristics for fire rating and sound rating. For example, to satisfy fire rating requirements, the structural boards can be adhered and fastened in the following non-critical areas: underneath bathtubs, closets, dead spaces, near walls, prone areas, under cabinets, under kitchen islands, and the like. One or more additional layers of the structural panels can be secured to the first layer to achieve a targeted thickness to provide a pour stop for the cementitious product.

Example Hybrid Underlayment Installations

FIGS. 1A, 1B, 1C, 1D, 1E, 1F, 1G, 1H, and 1I illustrate installation of an underlayment layer 100 of flooring using fiber boards 110, 112 for an inside corner binder. The flooring can be for single or multi-family housing, high and low-rise apartments and condominiums, motels, schools, professional buildings, assisted living facilities, or the like. The underlayment 100 extends between subfloor 102 and finish flooring 120. Underlayment 100 provides several functions including moisture blockage, cushioning, sound attenuation, fire rating, insulation, structure, and the like.

The subfloor 102 can be a cement slab or a wood subfloor. The finish flooring 120 can be any suitable flooring such as tile, wood, laminate, carpet, or the like. The subfloor 102 can extend between walls 104 that are either external walls or internal walls for a building.

FIG. 1A illustrates the subfloor 102 and walls 104 with an adhesive 111 deposited or applied in a pattern in a first portion of the subfloor 102. The adhesive 111 is configured to adhere an isolation board 110 to the subfloor within the first portion of the subfloor 102. The adhesive 111 can be, for example and without limitation, a polyurethane-based, moisture-curing subfloor bonding adhesive. The adhesive material is configured to be compatible with both the material of subfloor 102 and the isolation board 110.

Figure 1B:
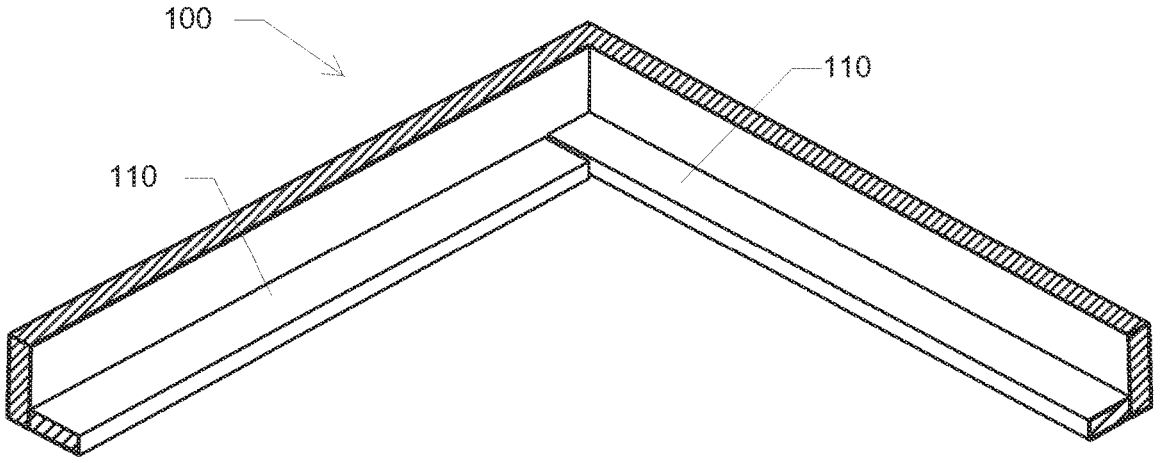

FIG. 1B illustrates installation of the isolation board 110 on the applied adhesive 111. The isolation board 110 is installed so that it lies within the first portion of the subfloor 102. The first portion of the subfloor is a non-critical area here it is advantageous to use structural boards instead of cementitious products. Non-critical areas include, for example and without limitation, underneath bathtubs, closets, dead spaces, near walls, prone areas, under cabinets, under kitchen islands, and the like. In some embodiments, the first portion covers an area that extends less than or equal to 96 inches from the wall 104, less than or equal to 48 inches from the wall 104, less than or equal 24 inches from the wall 104, less than or equal to 12 inches from the wall 104, less than or equal to 8 inches from the wall 104, or less than or equal to 6 inches from the wall 104. The isolation board 110 can be installed so that there is a gap 106 between adjacent isolation boards and the wall 104. The gap 106 can be about ⅛ inches to about 3/16 inches. The gap 106 can be configured to allow the isolation boards 110 to expand and contract.

The isolation board 110 can be a fiberboard, such as a cellulose fiberboard. The isolation board 110 can have a thickness of about ½ inch or between about ¼ inch and 1 inch. The isolation board 110 can be a fire-rated and/or sound-rated structural board tested and approved for construction purposes. Thus, the isolation board 110 can be different from the structural board 112 installed on top of the isolation board 110 because although the structural board 112 may possess similar fire-rating and sound-rating characteristics as the isolation board 110, the structural board 112 does not need to be tested and approved for construction purposes. For example, the isolation board 110 can be required to pass construction standards whereas the structural board 112 can be used without passing the same construction standards. However, it is to be understood that the isolation board 110 and the structural board 112 can be the same board (e.g., made from the same material with the same physical properties).

In some embodiments, the isolation board 110 comprises two or more structural boards pressed together to form a composite board. In some embodiments, the isolation board 110 is a structural board made from cellulose fiber. The isolation board 110 can be made using a homogeneous composition with protection against termites, rot and fungi and resistance to moisture. In some embodiments, the isolation board 110 is particleboard or fiberboard made from cellulose fibers, typically from wood, that are bonded together with a synthetic binder or resin. The isolation board 110 can be manufactured using man-made consolidated cellulosic articles, such as fiberboard, hardboard (e.g., low-density or high-density hardboard), soft board, high-density fiberboard (HDF), medium density fiberboard (MDF), chipboards, particleboard, medium-density particleboard, oriented strandboard (OSB), or the like. In some embodiments, the isolation board 110 can have a density between about 26 and about 28 lb./ft.$^3$. In some embodiments, the isolation board can comprise engineered wood products prepared from wood fiber extracted from chips and pulped wood waste. In certain embodiments, the isolation board 110 can have a density greater than about 50 lb/ft$^3$, including values of greater than 60 lb/ft$^3$, 70 lb/ft$^3$, 80 lb/ft$^3$, 90 lb/ft$^3$, or greater than 100 lb/ft$^3$. In certain implementations, to improve water resilience, processing oils can be added during the board formation under high temperature and pressure. In various embodiments, the isolation board 110 can be prepared from wood wastage fibers glued together with resin or glued under heat and pressure. In certain aspects, the isolation board 110 has a density of between about 30 lb/ft$^3$ and about 50 lb/ft$^3$, including values of 35 lb/ft$^3$, 40 lb/ft$^3$, and 45 lb/ft$^3$.

Figure 1C:
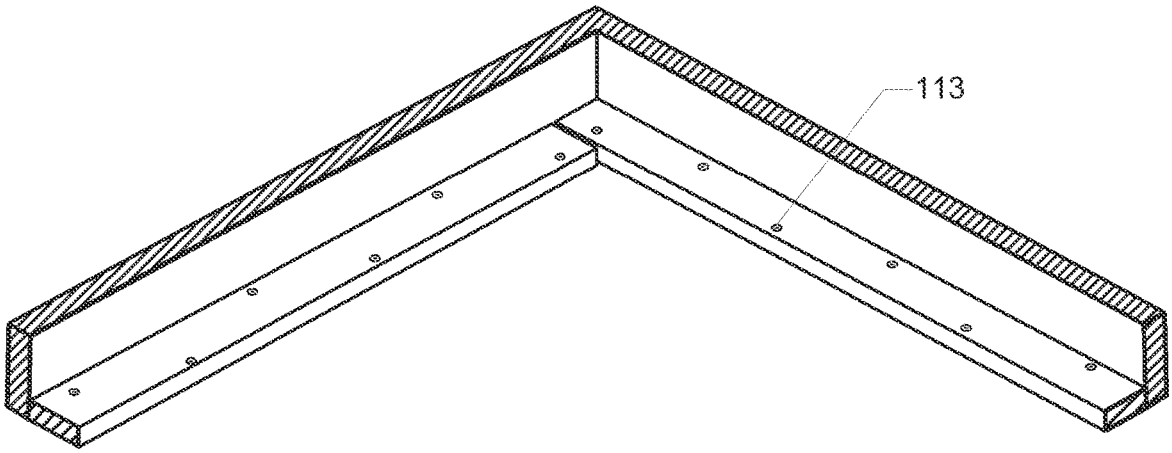

FIG. 1C illustrates one or more mechanical fasteners 113 (e.g., nails) being driven into the isolation board 110 to secure the isolation board 110 to the subfloor 102. Fastening the isolation board 110 to the subfloor 102 can be used to secure the isolation board 110 in place while the adhesive 111 cures or dries. In some embodiments, the nails 113 can be wire ring shank coil nails. The nails 113 can be, in some embodiments, 1.25"×0.080 15 deg. wire ring shank coil nails. The nails 113 can be installed or driven into the isolation board 110 using a ⅛-inch countersink. The nails 113 can be annular threaded nails or screws. The nails 113 can be installed at regular intervals in an offset pattern. In some embodiments, the nails can be spaced about 8 inches to about 10 inches apart and can be positioned at least about ½ inch away from an edge of the isolation board 110.

In some embodiments, the plurality of mechanical fasteners, e.g., either nails or screws, may be used to secure the isolation board 110. In some embodiments, the isolation board 110 may be secured to the subfloor 102 via any suitable adhesive, either independently of, or in conjunction with one or more mechanical fasteners.

Figure 1D:
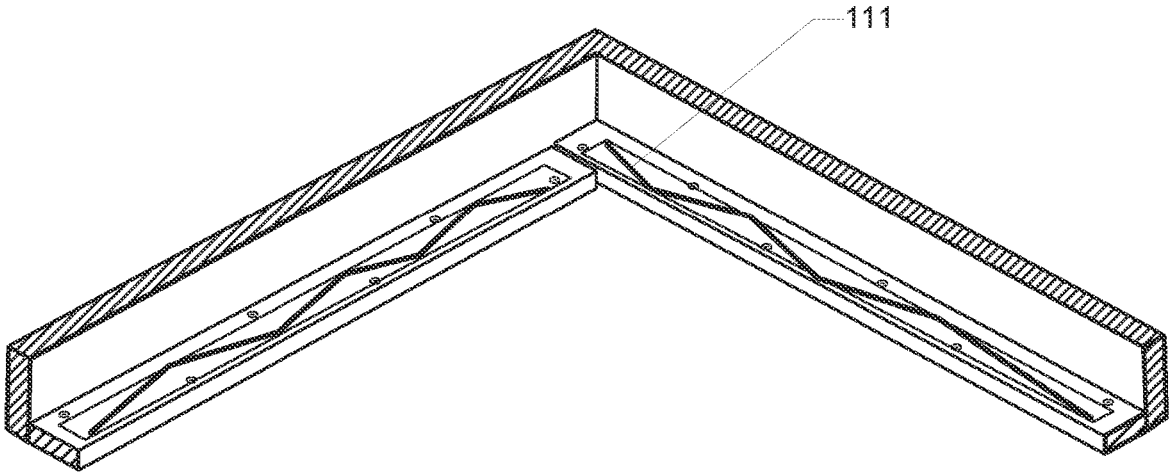
Figure 1E:
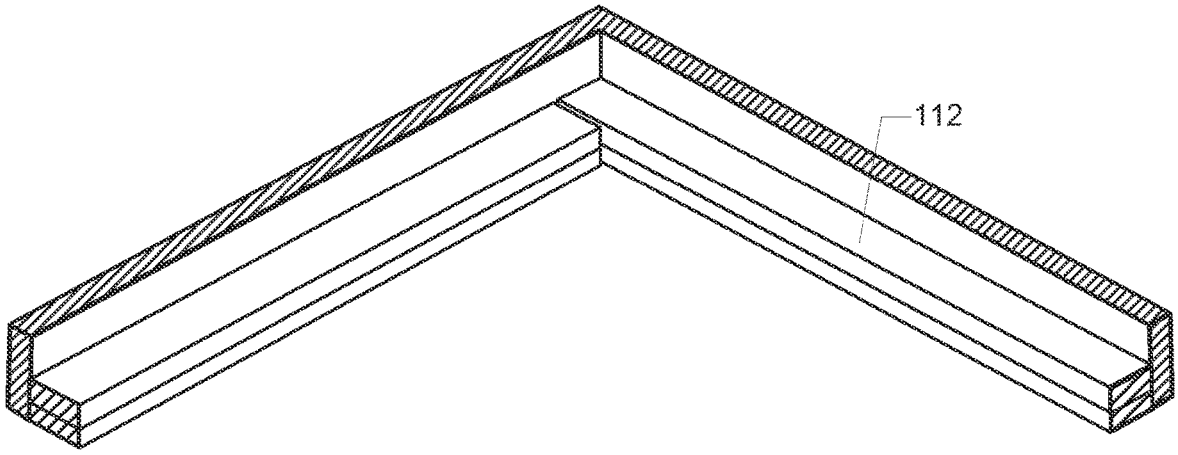

FIG. 1D illustrates application of another layer of the adhesive 111. FIG. 1E illustrates installation of the structural board 112 on top of the isolation board 110. The structural board 112 can be the same material as the isolation board 110. The structural board 112 can have the same or different thickness as the isolation board 110. The structural board 112 and the isolation board combine to form a barrier or pour stop for the cementitious product 115. In some embodiments, the structural board 112 is a class A, 1-hour, fire-rated, water-resistant type board. The structural board 112 can be a pressed structural type board made from either cellulose fiber, wood, sheathing, or fiberglass matted material. The structural board 112 can be cut or milled from a board or panel, being cut into strips ranging from about 1 inch to about 48 inches in width with a thickness from about ½ inch to about 1.5 inches. In some embodiments, the structural board has a width that is greater than or equal to about 4 inches and less than or equal to about 6 inches, greater than or equal to about 3 inches and less than or equal to about 12 inches, greater than or equal to about 2 inches and less than or equal to about 24 inches, or greater than or equal to about 1 inches and less than or equal to about 48 inches.

The structural board 112 and the isolation board 110 can be selected, milled, and stacked so that corresponding edges of each board align with one another. This can be done to maintain the gap 106 between adjacent boards and the wall 104. However, in some embodiments as described herein, the isolation board 110 and the structural board 112 can be offset from one another.

Figure 1F:
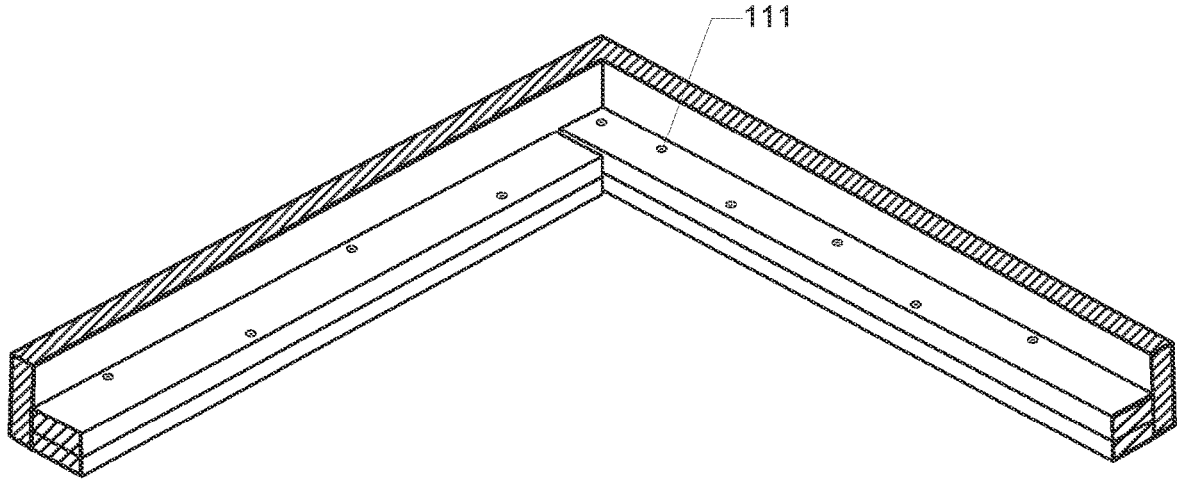

FIG. 1F illustrates one or more nails 113 being driven into the structural board 112 to secure the structural board 112 to the isolation board 110. Fastening the structural board 112 to the isolation board 110 can be used to secure the structural board 112 in place while the adhesive 111 cures or dries.

Figure 1G:
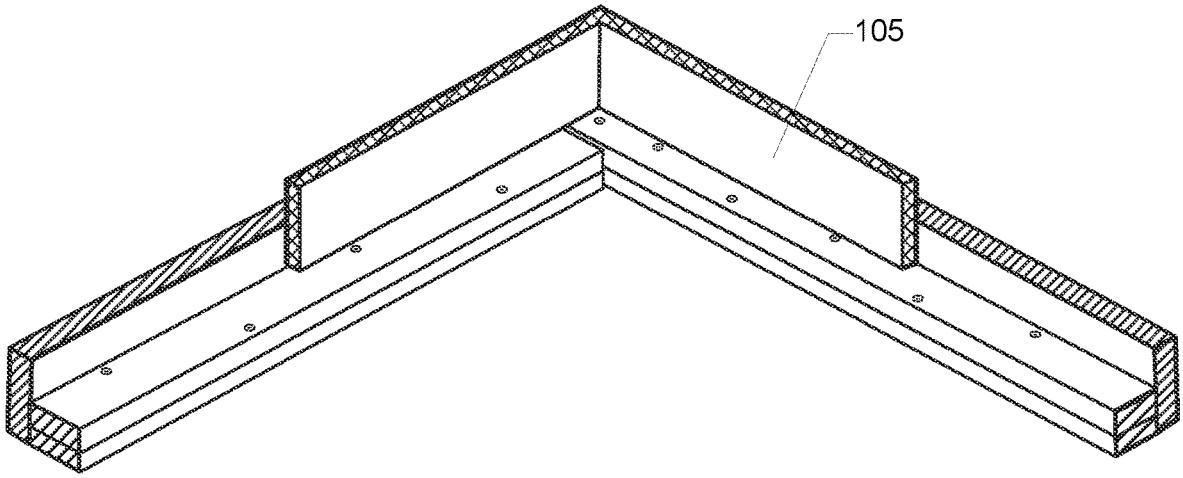

FIG. 1G illustrates installation of drywall 105 over the top layer of the underlayment 100. The drywall 105 can be configured to be installed on top of the structural board 112. In some embodiments, the drywall 105 can be installed in a gap between the wall 104 and the combination of the isolation board 110 and the structural board 112 so that the drywall 105 and the combined boards are butted up to one another.

Figure 1H:
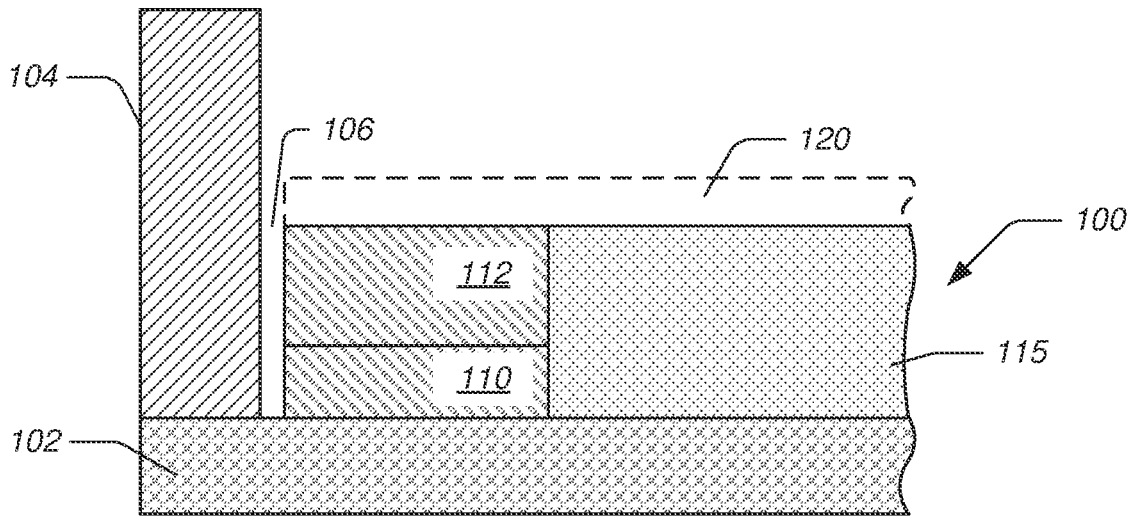
FIGS. 1H and 1I illustrate cross-sections of the flooring of FIGS. 1A-1G after installation of a cementitious product.

FIG. 1H illustrates a cementitious product 115 installed onto the flooring system of FIGS. 1A-1F. After the installation procedure described and illustrated in FIGS. 1A-1F (and before or after installation of the drywall 105 in FIG. 1G), the cementitious product 115 can be poured to form a poured underlayment that abuts an edge of the combination of the isolation board 110 and the structural board 112 and, preferably, adheres thereto. The term "pour" is used broadly herein to encompass any suitable method for applying the cementitious product 115 so that the cementitious product 115 is directed to flow, or spread, over the subfloor 102. In some embodiments, the area over which the cementitious product 115 is to be poured can be primed prior to pouring. The primer can be applied for example, via spraying or rolling, according to known methods.

The cementitious product 115 can be a self-leveling gypsum cement or other cementitious lightweight concrete. The term light-weight concrete is used herein as a generic description for a concrete topping that is less dense than standard concrete. An example of the cementitious product 115 includes a material commonly referred to as gypsum concrete or gyp-crete. Gyp-crete is a building material that can be used as a floor underlayment in wood-frame and concrete construction for fire ratings, sound reduction, radiant heating, and floor leveling. Gyp-crete comprises atmospheric calcined gypsum, sand, water, and small amounts of various additives. Additives may include polyvinyl alcohol, an extender such as sodium citrate or fly ash, a surfactant such as colloid defoamer 1513 DD made by Colloids, Inc., and a fluidizer based on sodium or potassium derivatives of naphthalene sulfonate formaldehyde condensate.

The combination of the structural board 112 and the isolation board 110 form a barrier to the cementitious product as it is poured. The cementitious product 115 can be poured until it is level with a top side of the structural board 112 to form a level underlayment 100. Thus, the isolation board 110 (in combination with the structural board 112) can cover a first portion of the subfloor 102 while the cementitious product 115 can cover a second portion of the subfloor 102. In total, the first portion and the second portion can make up the entire area of the subfloor 102, or the total area of the subfloor 102 that is to receive the underlayment 100. The first portion can be divided into various locations, wherein individual first portion locations have a size approximately equal to a footprint of a fixture, for example, a bathtub, a closet, a kitchen island, cabinets, or the like. The first portion may be designated as a pre-pour area over isolation board 110 and structural board 112 is laid prior to installing the fixture. The second portion is located adjacent to the first portion, making up the remainder of the subfloor 102. The second portion is left substantially exposed for the installation of the poured cementitious product 115.

Figure 1I:
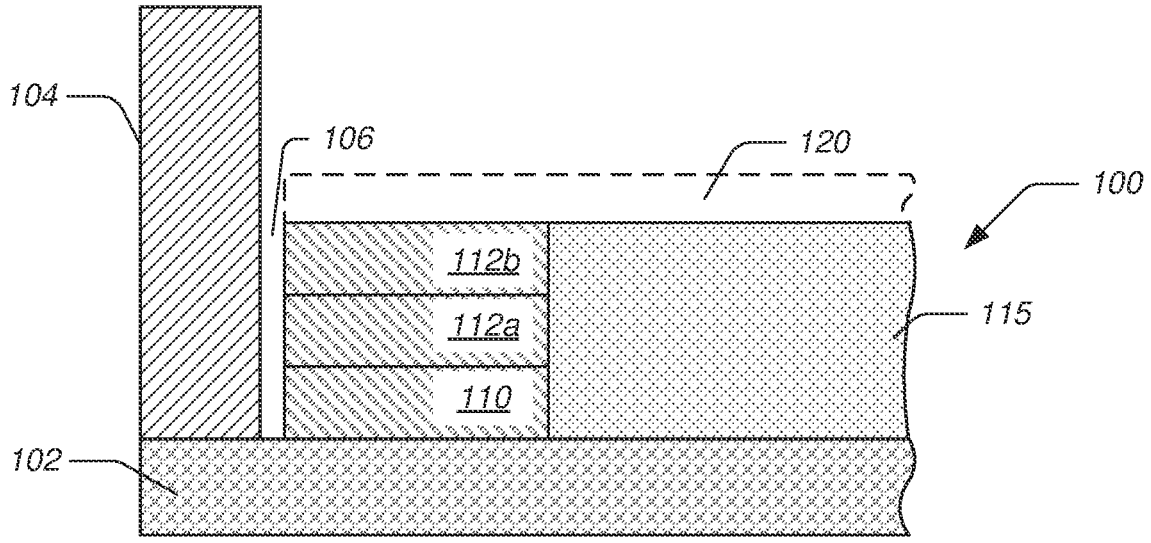

FIG. 1I illustrates the underlayment 100 wherein two structural boards 112*a*, 112*b* are used to achieve a targeted thickness. Thus, one or more structural boards 112 can be used to achieve the targeted thickness. Additionally, after the underlayment 100 has been installed, finish flooring 120 can be installed to finish installation of the flooring system.

FIGS. 2A, 2B, 20, 2D, 2E, and 2F illustrate another example installation of an underlayment layer 200 of flooring using fiberboards for a perimeter board binder. The installation follows the same installation steps described herein with reference to FIGS. 1A-1F except that the structural board 112 is installed offset from the insulation board 110 so that the gap 206*a* between adjacent isolation boards 110 does not align with the gap 206*b* between adjacent structural boards 112.

Figure 2A:
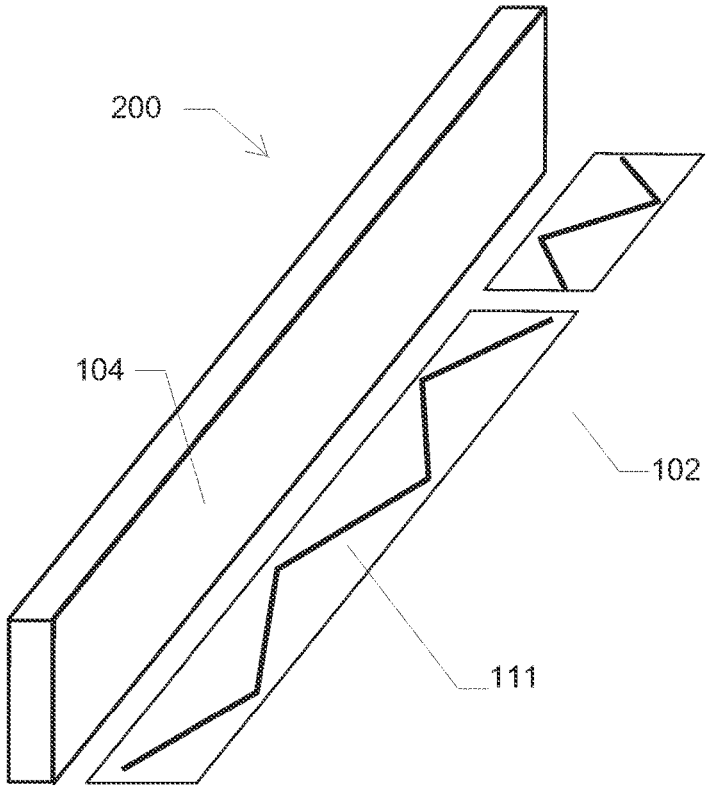
Figure 2B:
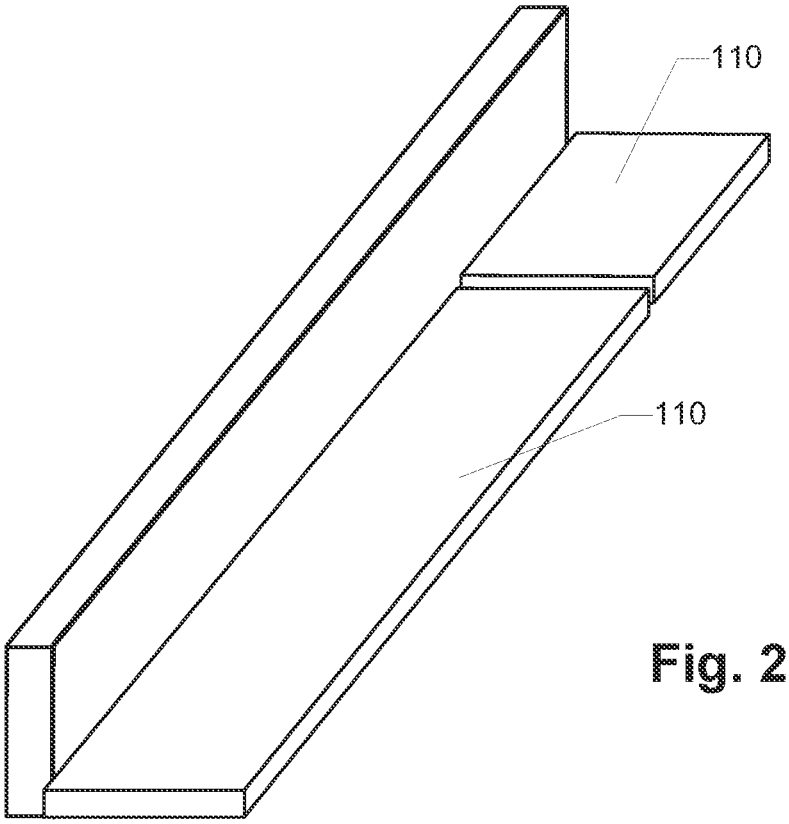
Figure 2C:
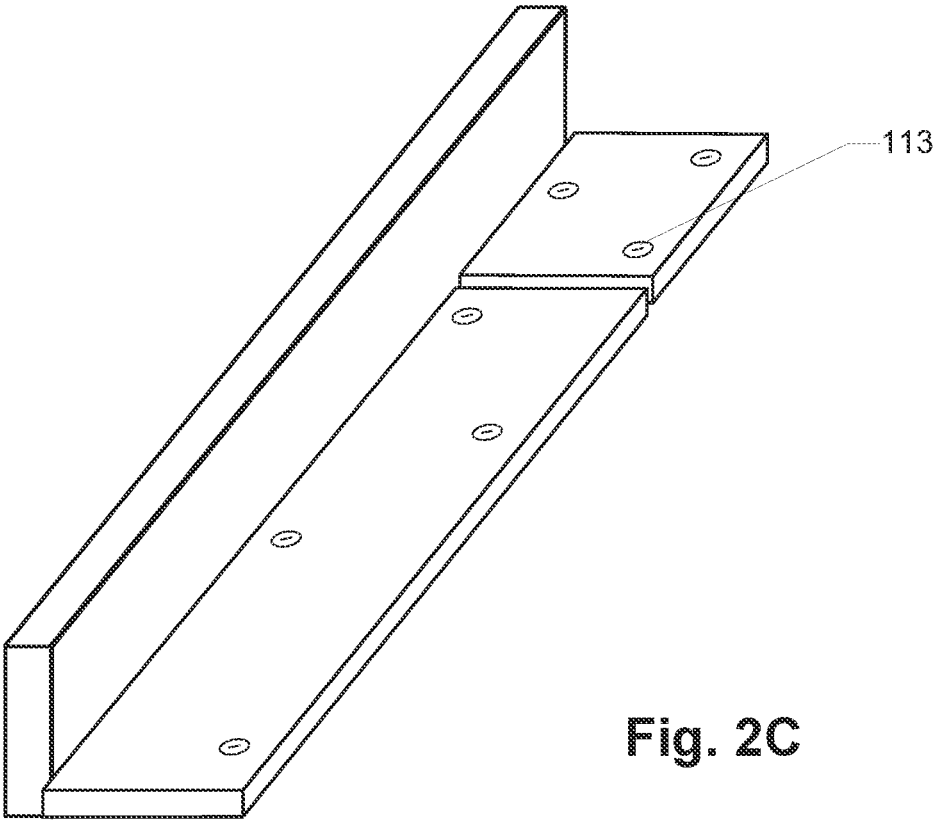
Figure 2D:
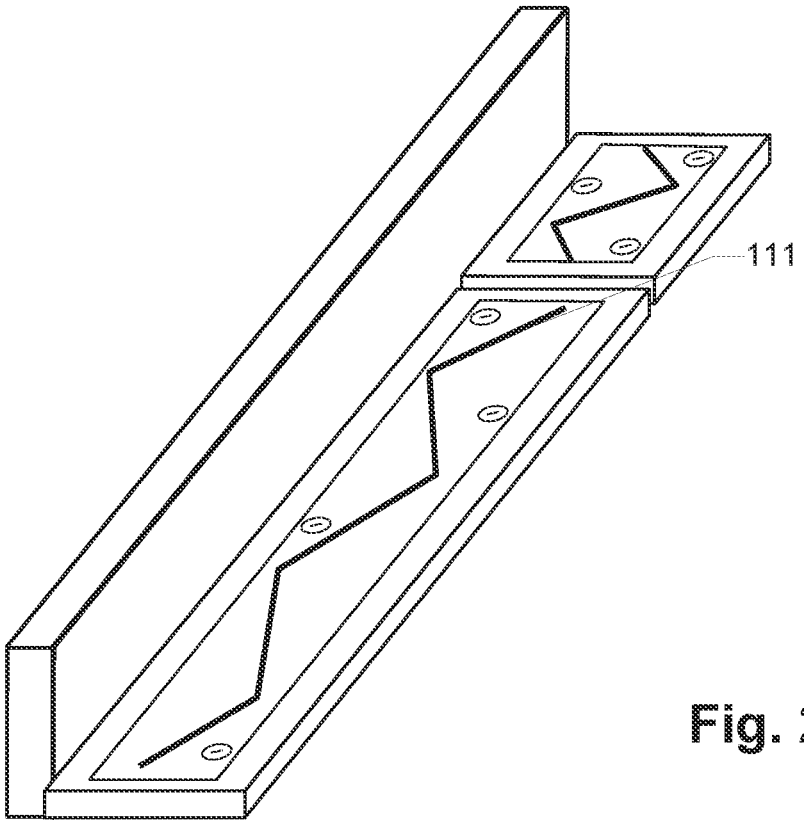
Figure 2E:
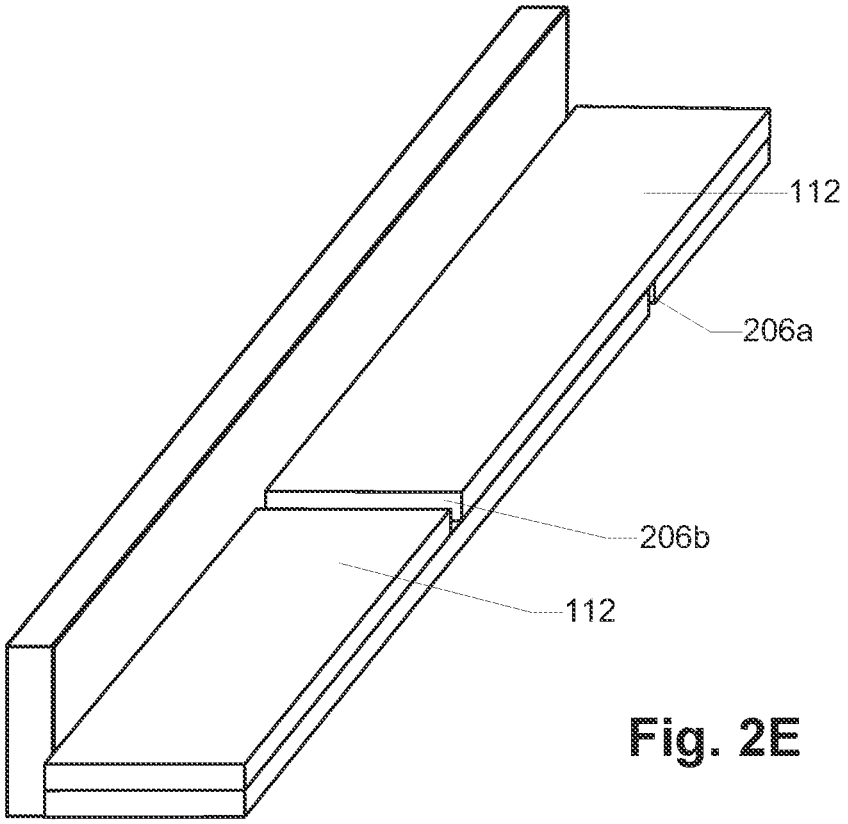
Figure 2F:
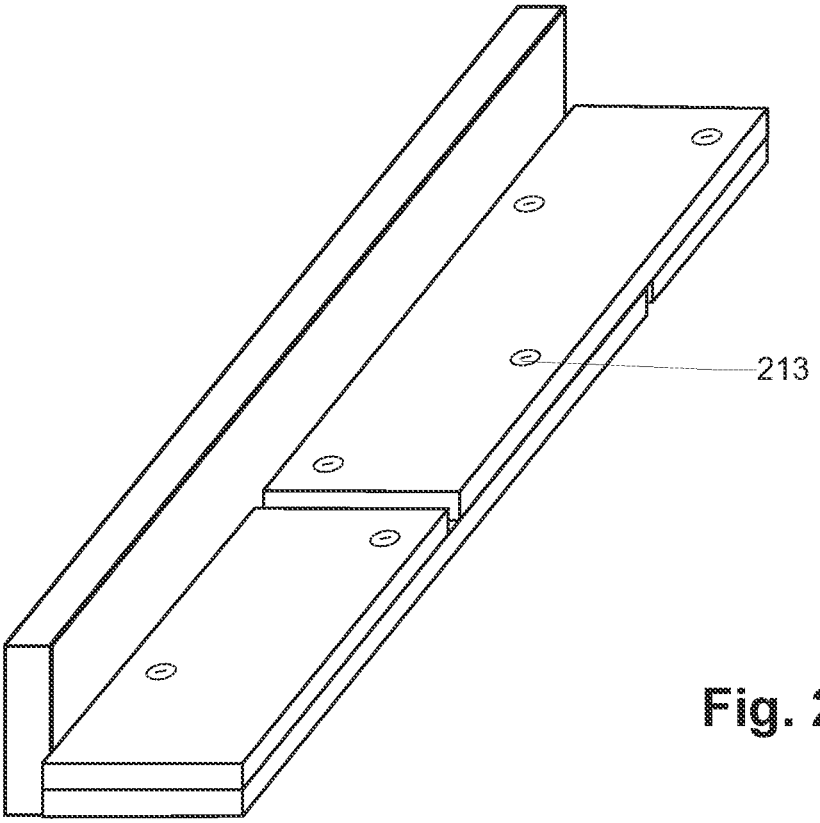

FIG. 2A illustrates application of the adhesive 111 to the subfloor 102. FIG. 2B illustrates installation of the isolation boards 110 on the subfloor 102. FIG. 2C illustrates using mechanical fasteners 113 to secure the isolation board 110 to the subfloor 102 to allow the adhesive 111 to dry. FIG. 2D illustrates application of the adhesive 111 to a topside of the isolation boards 110. FIG. 2E illustrates installation of the structural boards 112 on top of the isolation boards 110 so that they are offset horizontally from one another. That is, the edges of the isolation boards 110 and the structural boards 112 closest to the wall 104 are aligned, the edges of the isolation boards 110 and the structural boards 112 furthest from the wall 104 are aligned, but the perpendicular edges to these are not aligned so that gap 206*a* and gap 206*b* are not aligned. FIG. 2F illustrates using mechanical fasteners 113 to secure the structural boards 112 to the isolation boards 110 to allow the adhesive 111 to dry.

Figure 3A:
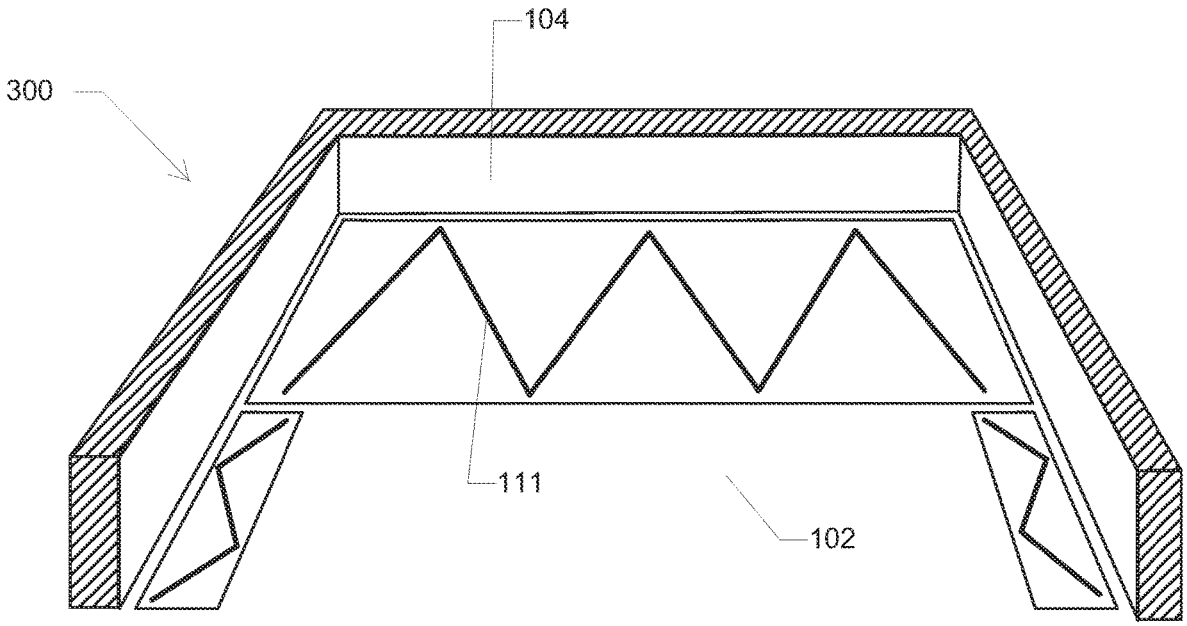
FIGS. 3A and 3B illustrate another example installation of an underlayment layer under a bathroom tub.
Figure 3B:
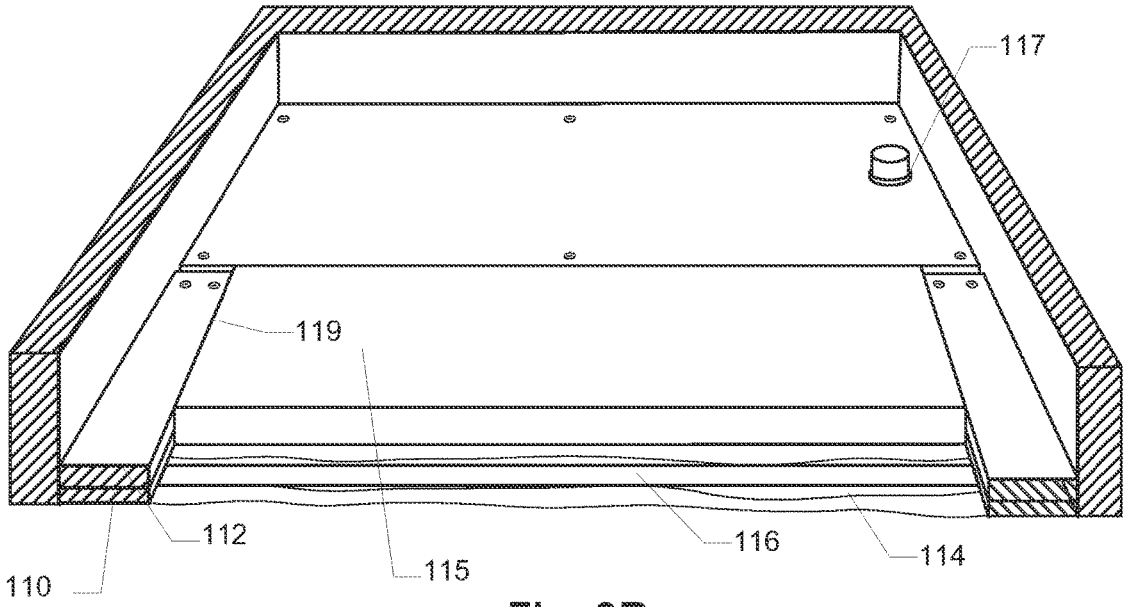

FIGS. 3A and 3B illustrate another example installation of an underlayment layer 300 under a bathroom tub. FIG. 3A illustrates the subfloor 102 and walls 104 with the adhesive 111 illustrated to adhere the first layer of isolation boards 110, similar to the installation process described herein with reference to FIG. 1A.

FIG. 3B illustrates after the underlayment installation procedure has been completed. The underlayment 300 includes isolation boards 110 installed in a first portion of the subfloor 102, structural boards 112 installed on top of, and aligned with, the isolation boards 110. Although a single layer of structural boards 112 is illustrated, two or more layers of structural boards 112 can be installed, similar to the installation described herein with reference to FIG. 1I. Each structural board 112 can have a different thickness from each other or the same thickness. Similarly, one or more structural boards 112 can have the same thickness as the isolation board 110. In this way, the of the isolation board 110 and/or a combination of the isolation board 110 and one or more structural boards 112 can be used to build a pour barrier to a targeted thickness corresponding to a targeted thickness of the cementitious product 115.

The underlayment 300 includes the poured cementitious product 115 poured and installed in the second portion of the subfloor 102. Prior to pouring the cementitious product 115, a sound control membrane 114 can be installed in the second portion of the subfloor 102. The sound control membrane 114 can be configured for sound control, sound attenuation, and/or sound abatement. The sound control membrane 114 may also function as a vapor barrier and may include a sheet of polyethylene film resting upon the reinforced-concrete subfloor 102. The sound control membrane 114 may supplied in rolls and have adhesive-backed edges for overlapping with one another to secure the abutting edges together. In some embodiments, as shown here, a separate tape material 116 may be used for this purpose. The sound control membrane 114 may be formed from fused entangled filaments of a nylon material attached to a non-woven nylon fabric, or from blends of polymeric fibers having a nylon reinforcement. The tape material 116 may be, e.g., duct tape, poly-stucco tape, cloth tape, scrim-backed tape, or pressure-sensitive tape. The tape material 116 may be coated with polyethylene.

Caulking 117 is applied to any component that penetrates through the isolation boards and/or subfloor 102. The caulking 117 can be, e.g., fire-rated caulking and can be installed or applied around piping and any gaps larger than about 3/16 inches. Caulking 117 can be applied to help with expansion and for places that require penetration.

A sealant 119 may be applied at intersection locations between structural boards 112 and/or intersections between the structural boards 112 and the cementitious product 115. The sealant 119 can be applied on top of the cementitious product 115 and the structural boards to protect the seam to make it smooth for finish flooring installed on the top thereof.

Figure 4A:
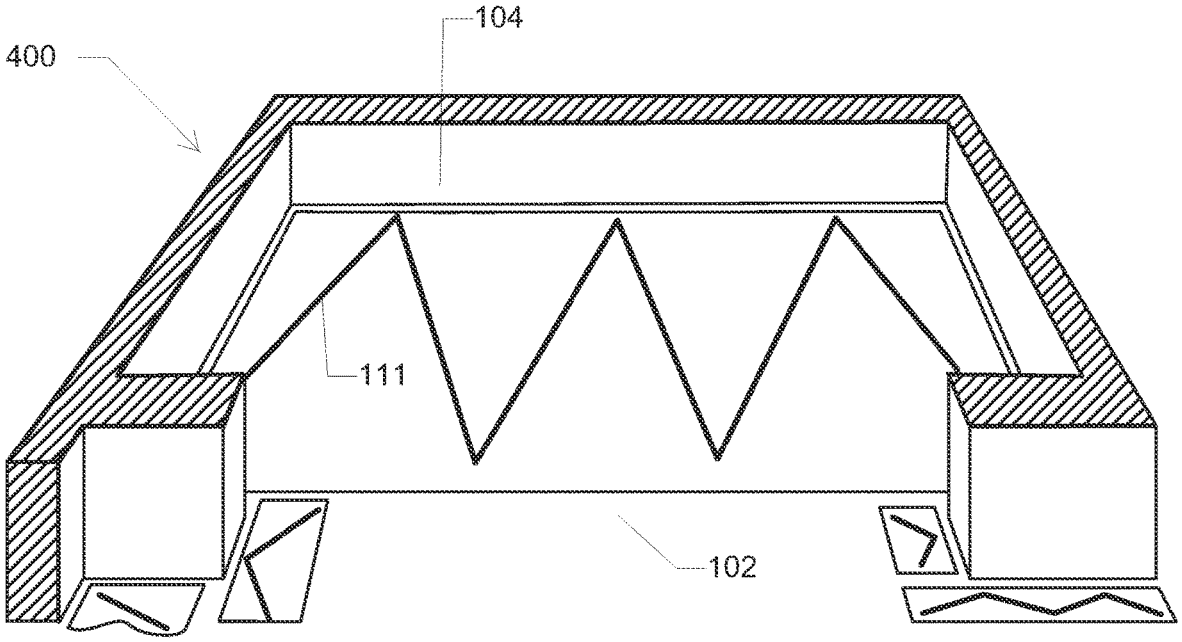
FIGS. 4A and 4B illustrate another example installation of an underlayment layer under a closet.
Figure 4B:
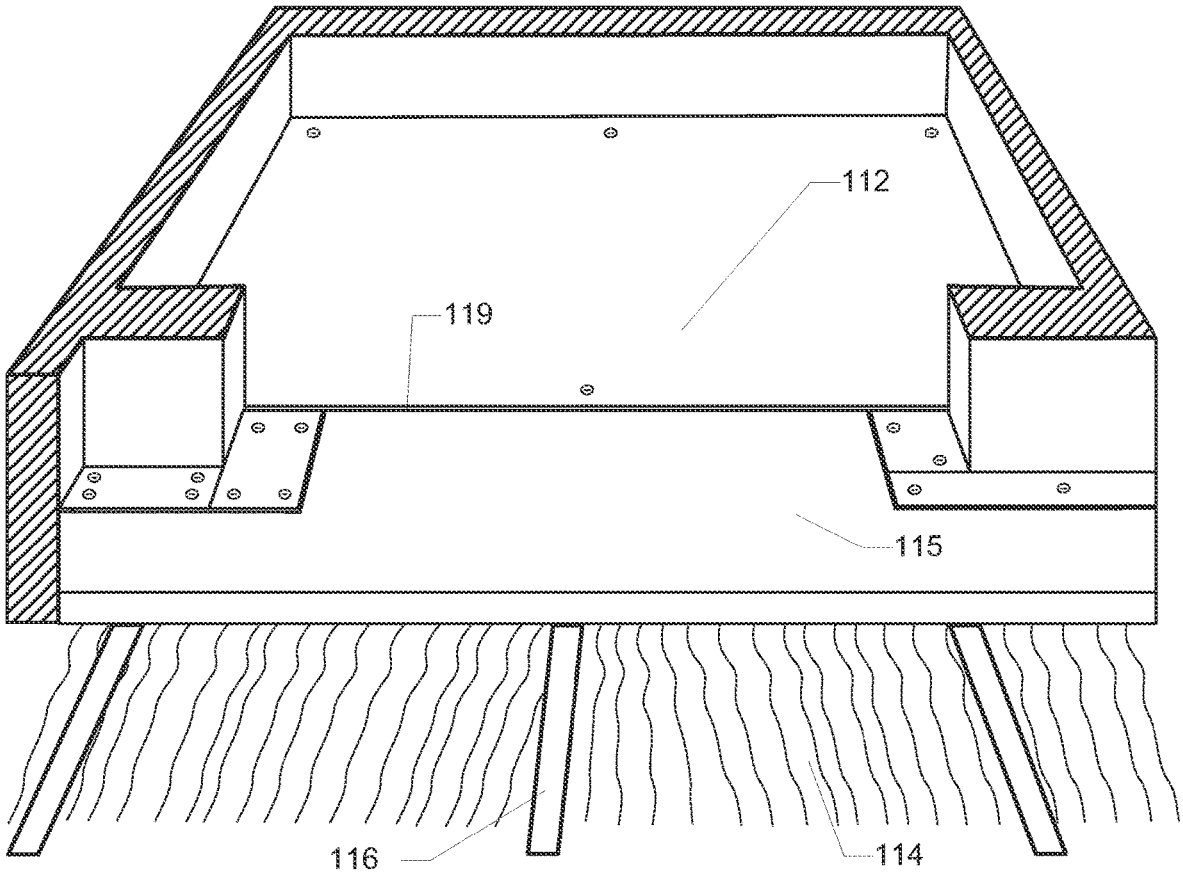

FIGS. 4A and 4B illustrate another example installation of an underlayment layer 400 under a closet. The installation follows the same installation steps described herein with reference to FIGS. 3A and 3B but for a different portion of a building (e.g., under a closet rather than under a bathtub). The corresponding callouts reference the same components so a description of these components will not be repeated again for the sake of conciseness.

Figure 5A:
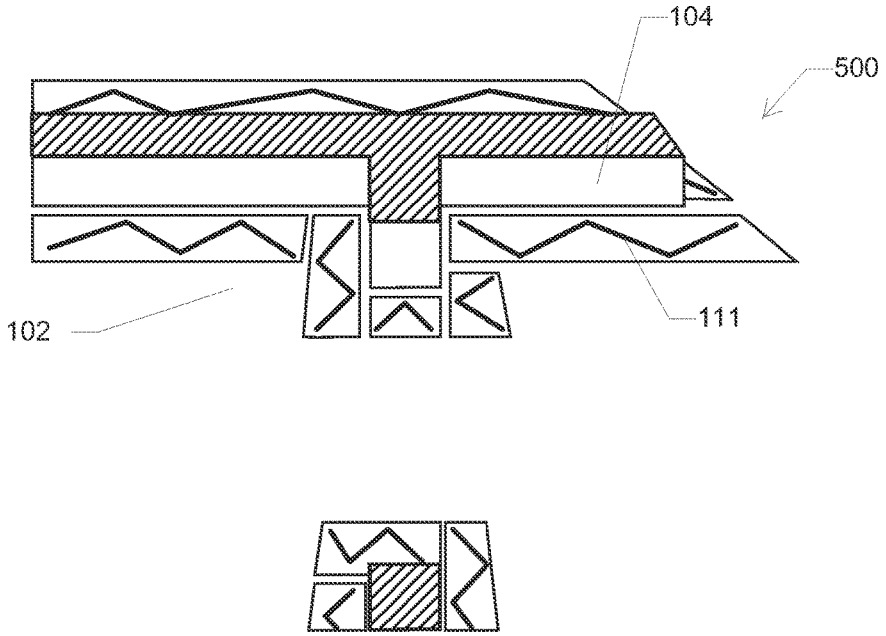
FIGS. 5A and 5B illustrate another example installation of an underlayment layer for an outside corner binder.
Figure 5B:
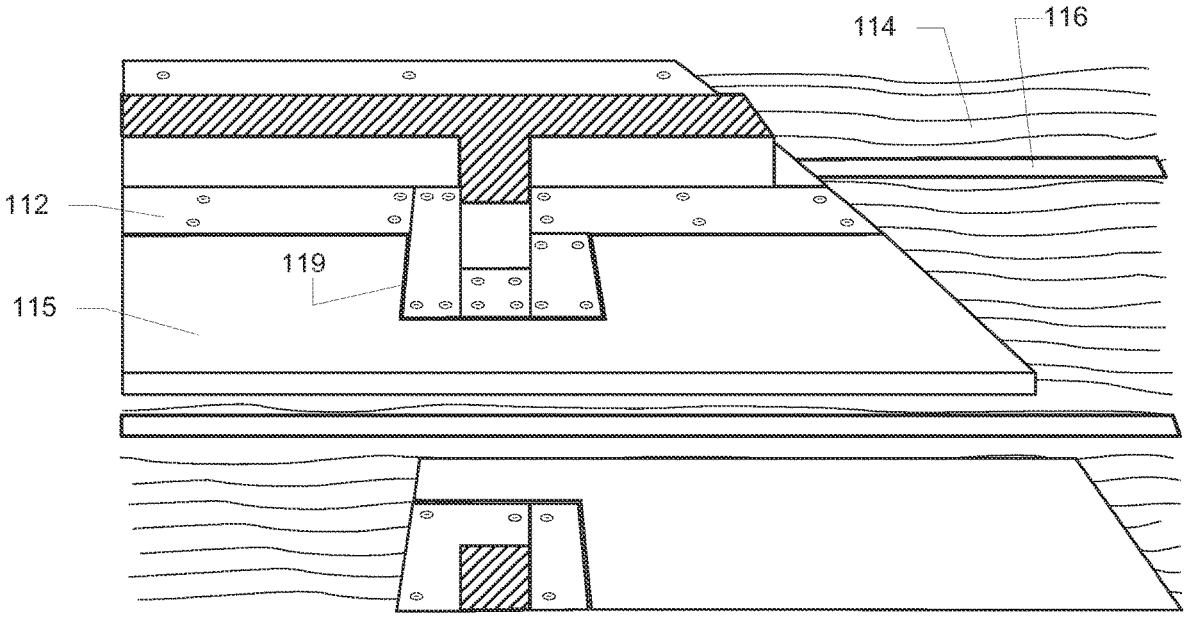

FIGS. 5A and 5B illustrate another example installation of an underlayment layer 500 for an outside corner binder. The installation follows the same installation steps described herein with reference to FIGS. 3A and 3B but for a different portion of a building (e.g., an outside corner binder rather than under a bathtub). The corresponding callouts reference the same components so a description of these components will not be repeated again for the sake of conciseness.

Figure 6A:
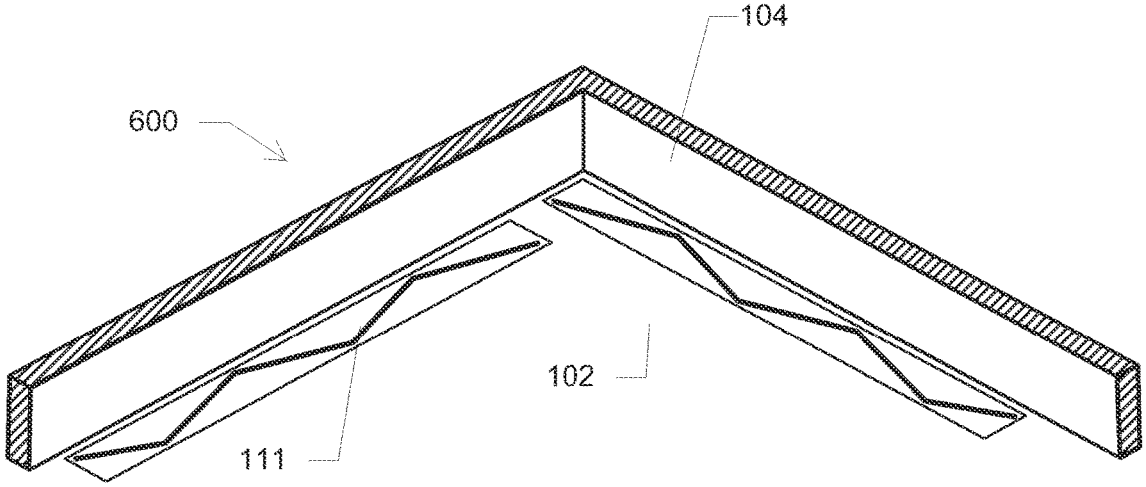
FIGS. 6A and 6B illustrate installation of an underlayment layer for an inside corner binder.
Figure 6B:
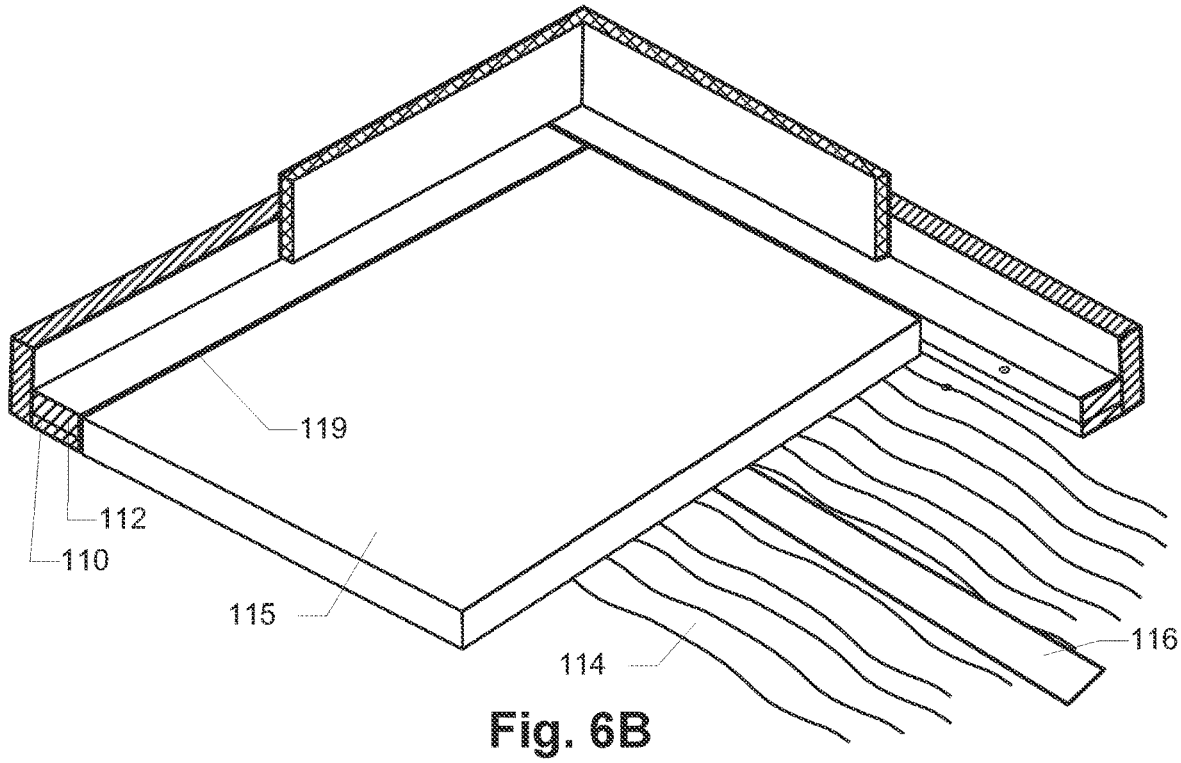

FIGS. 6A and 6B illustrate installation of an underlayment layer 600 for an inside corner binder. The installation follows the same installation steps described herein with reference to FIGS. 3A and 3B but for a different portion of a building (e.g., an inside corner binder rather than under a bathtub). The corresponding callouts reference the same components so a description of these components will not be repeated again for the sake of conciseness.

Figure 7A:
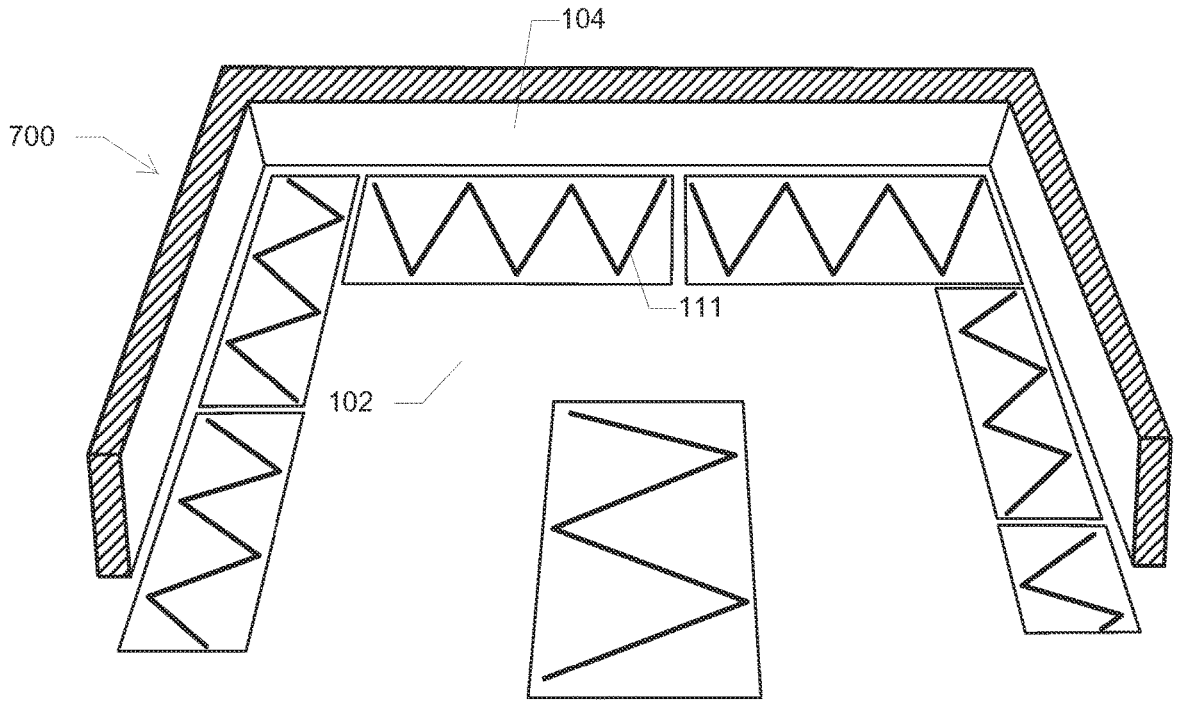
FIGS. 7A and 7B illustrate installation of an underlayment layer for an island in a kitchen.
Figure 7B:
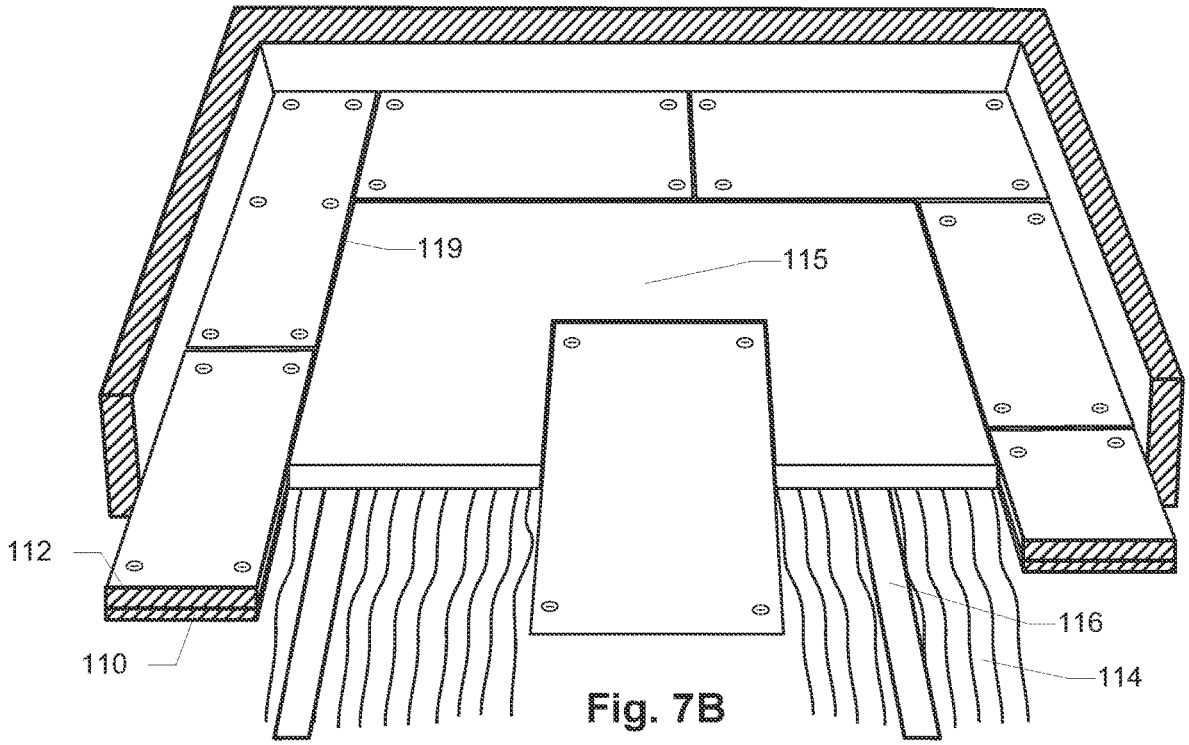

FIGS. 7A and 7B illustrate installation of an underlayment layer 700 for an island in a kitchen. The installation follows the same installation steps described herein with reference to FIGS. 3A and 3B but for a different portion of a building (e.g., under an island in the kitchen rather than under a bathtub). The corresponding callouts reference the same components so a description of these components will not be repeated again for the sake of conciseness.

Figure 8A:
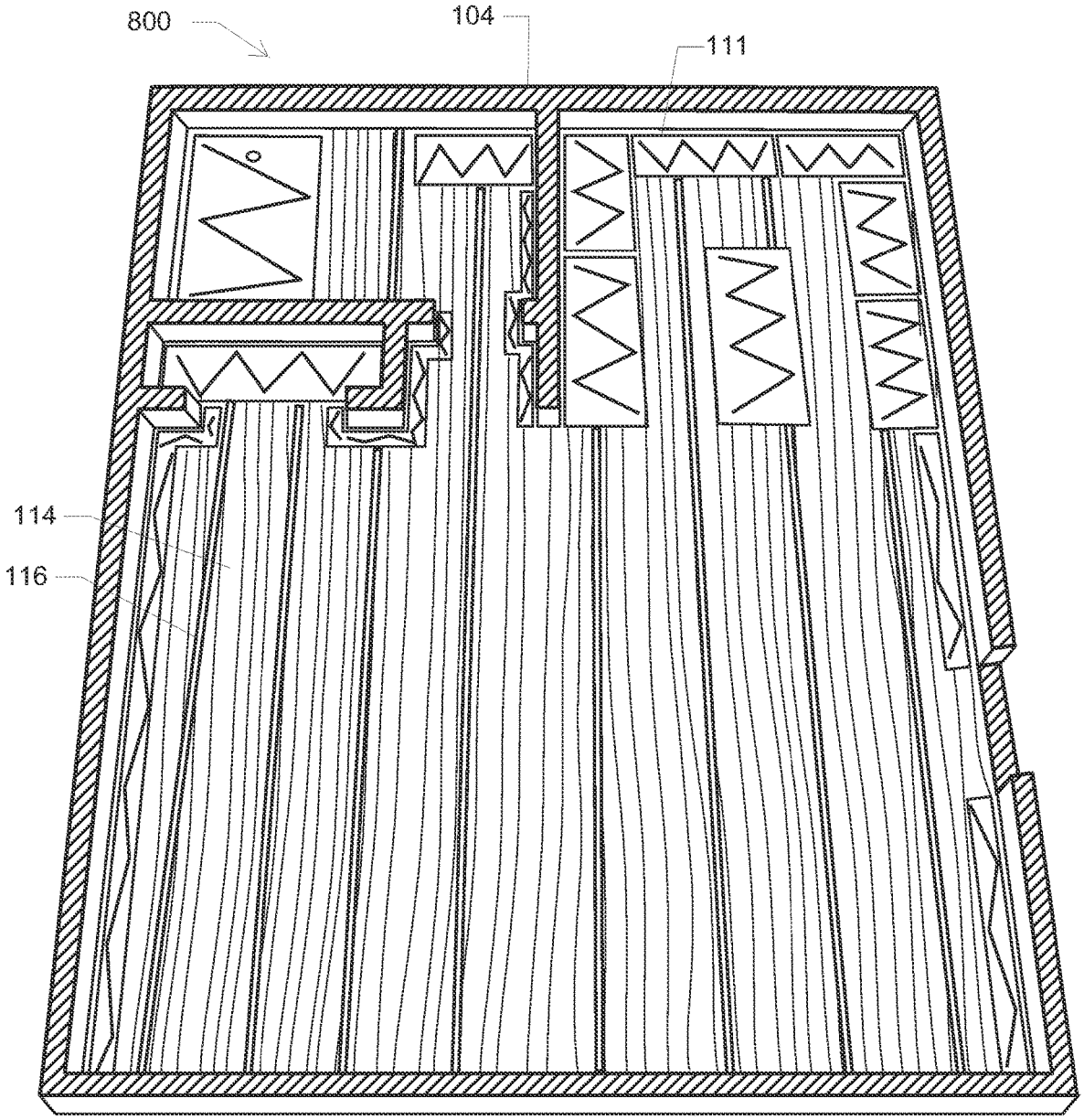
FIGS. 8A and 8B illustrate installation of an underlayment layer of flooring in a dwelling.
Figure 8B:
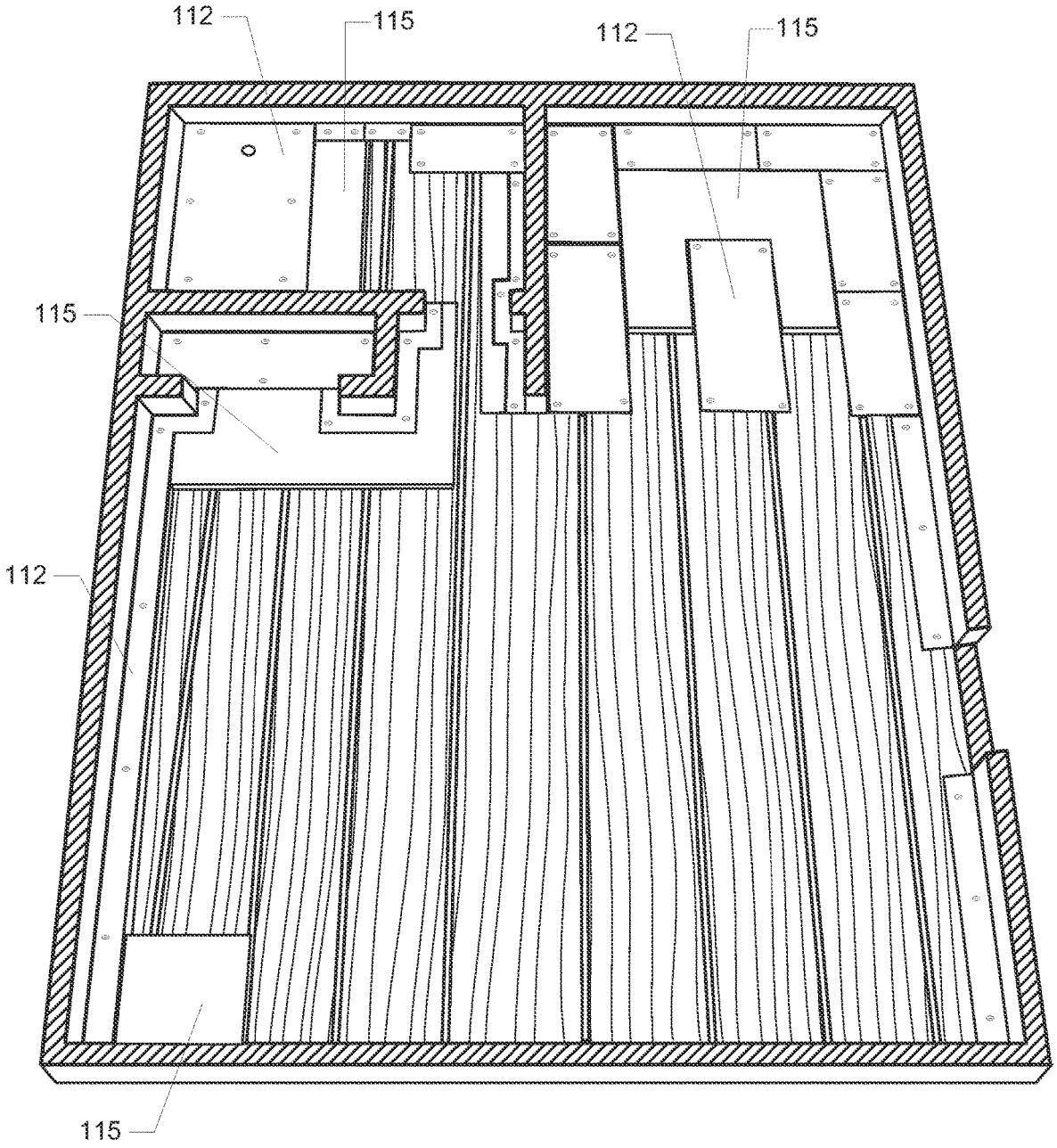

FIGS. 8A and 8B illustrate installation of an underlayment layer 800 of flooring in a dwelling. The installation follows the same installation steps described herein with reference to FIGS. 3A-7B but are for an entire dwelling, including all the locations described in FIGS. 3A-7B. The dwelling is a studio-style apartment, but the disclosed installation steps can be applied to various other building and dwelling types. The corresponding callouts reference the same components so a description of these components will not be repeated again for the sake of conciseness.

FIGS. 9A, 9B, 9C, 9D, 9E, and 9F illustrate another example installation of an underlayment layer 900 of flooring using fiberboards for an outside corner binder. The installation follows the same installation steps described herein with reference to FIGS. 2A-2F but are for a different portion of a building (e.g., an outside corner binder rather than a perimeter binder).

Figure 9A:
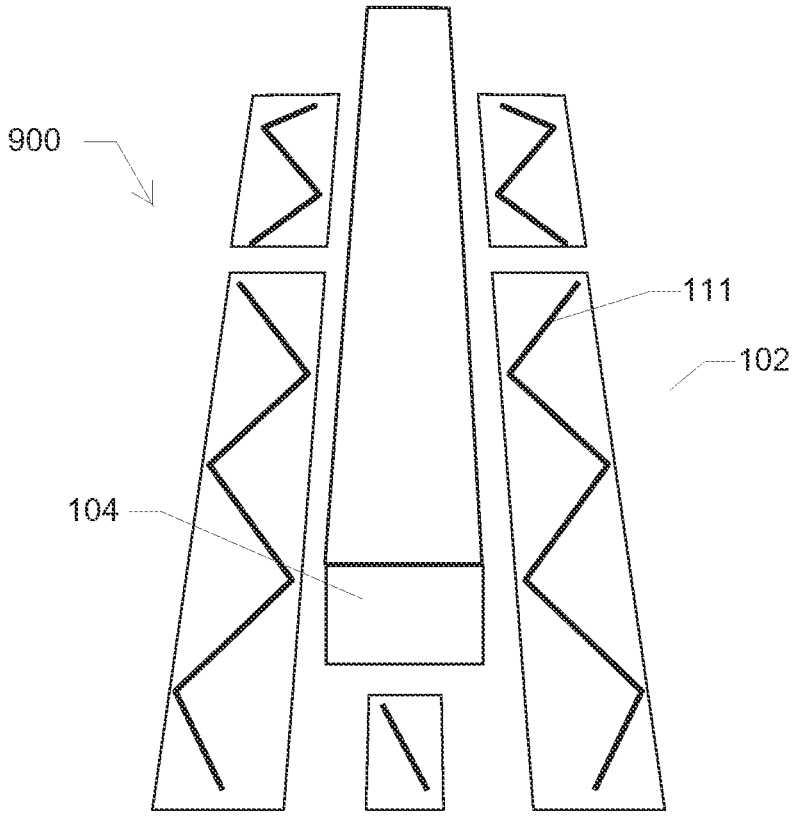
FIGS. 9A, 9B, 9C, 9D, 9E, and 9F illustrate another example installation of an underlayment layer of flooring using fiber boards for an outside corner binder.
Figure 9B:
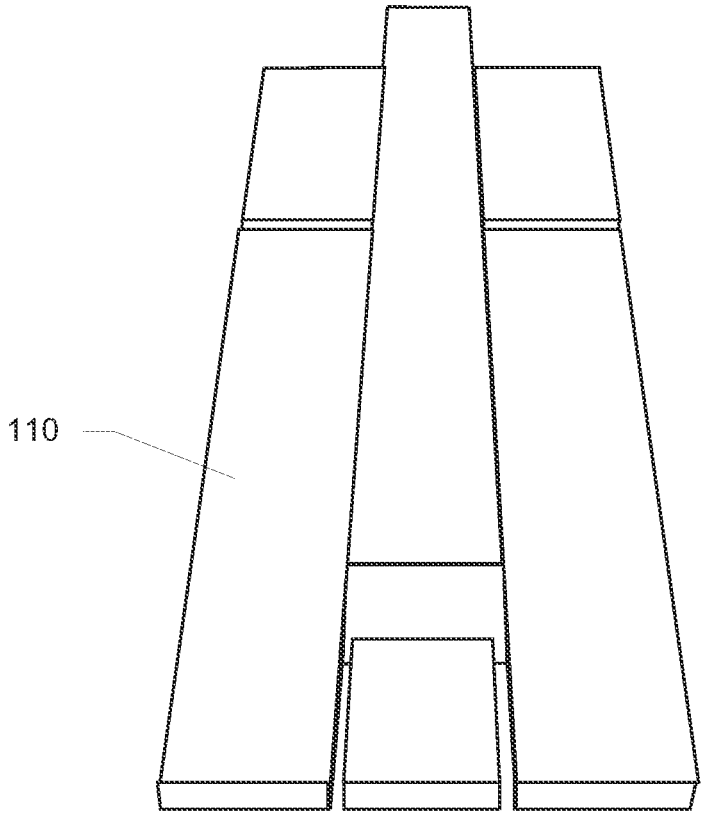
Figure 9C:
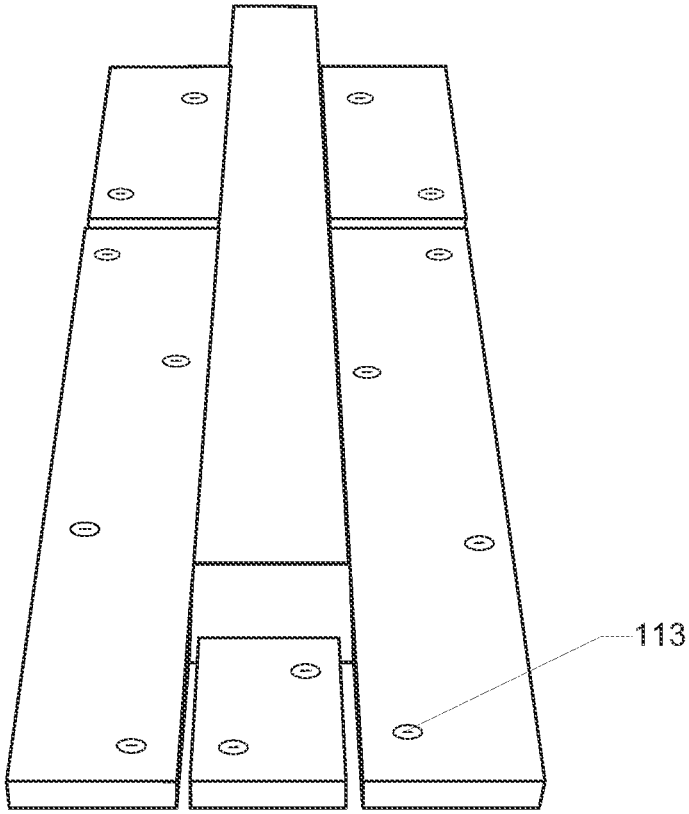
Figure 9D:
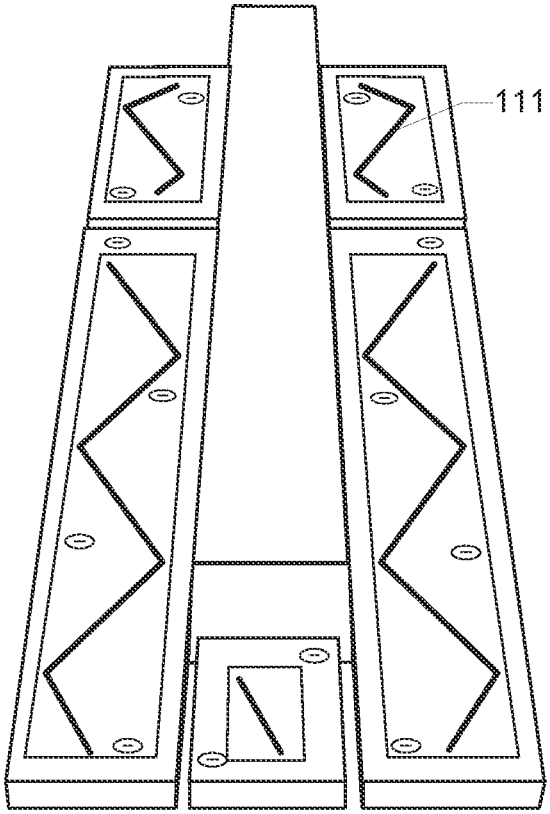
Figure 9E:
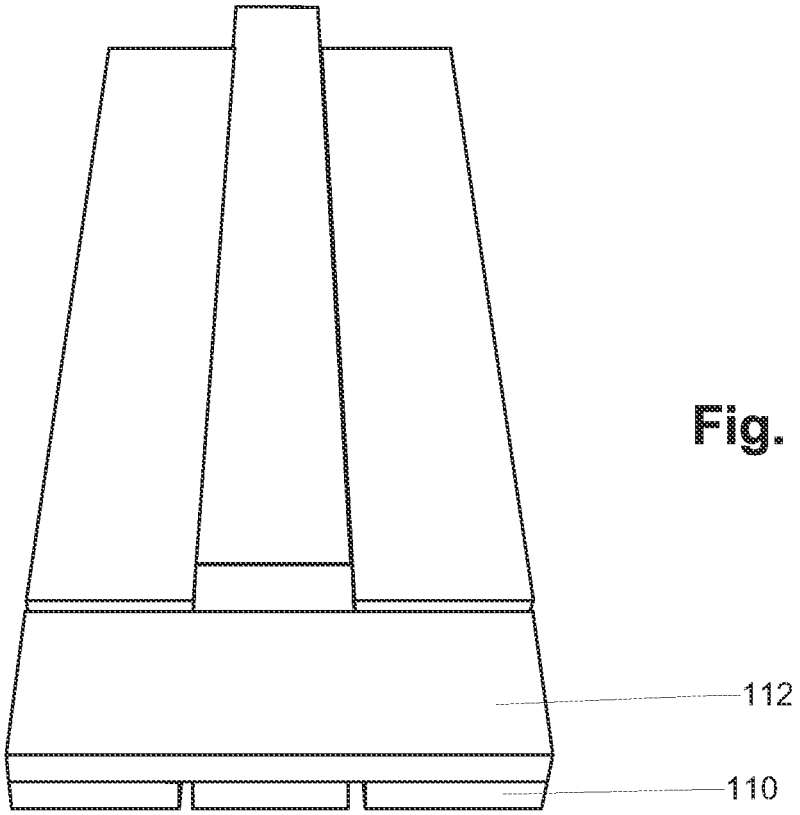
Figure 9F:
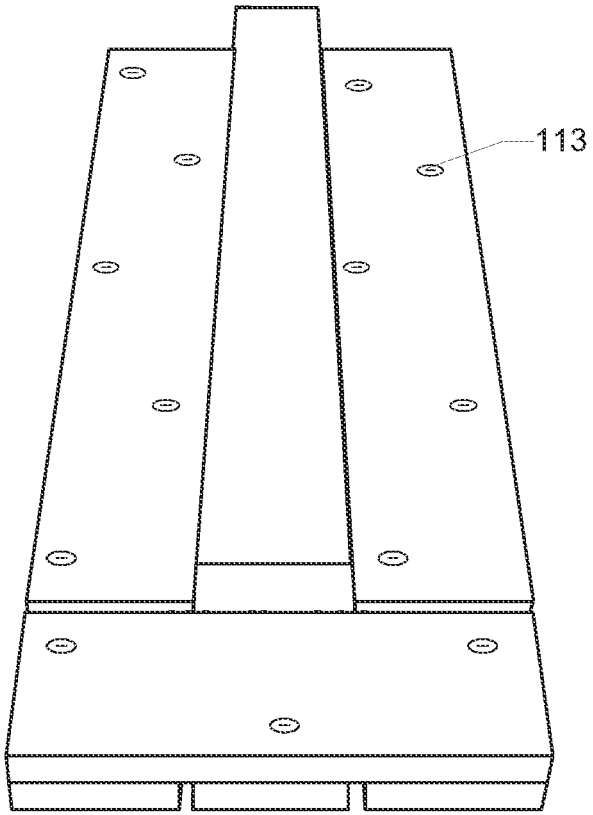

FIG. 9A illustrates application of the adhesive 111 to the subfloor 102. FIG. 9B illustrates installation of the isolation boards 110 on the subfloor 102. FIG. 9C illustrates using mechanical fasteners 113 to secure the isolation board 110 to the subfloor 102 to allow the adhesive 111 to dry. FIG. 9D illustrates application of the adhesive 111 to a topside of the isolation boards 110. FIG. 9E illustrates installation of the structural boards 112 on top of the isolation boards 110 so that they are offset horizontally from one another. FIG. 9F illustrates using mechanical fasteners 113 to secure the structural boards 112 to the isolation boards 110 to allow the adhesive 111 to dry.

FIGS. 10A, 10B, 10C, 10D, 10E, 10F, and 10G illustrate another example installation of an underlayment layer 1000 of flooring using fiberboards as a bathtub binder. The installation follows the same installation steps described herein with reference to FIGS. 2A-2F but are for a different portion of a building (e.g., underneath a bathtub in a finished building rather than a perimeter binder).

Figure 10A:
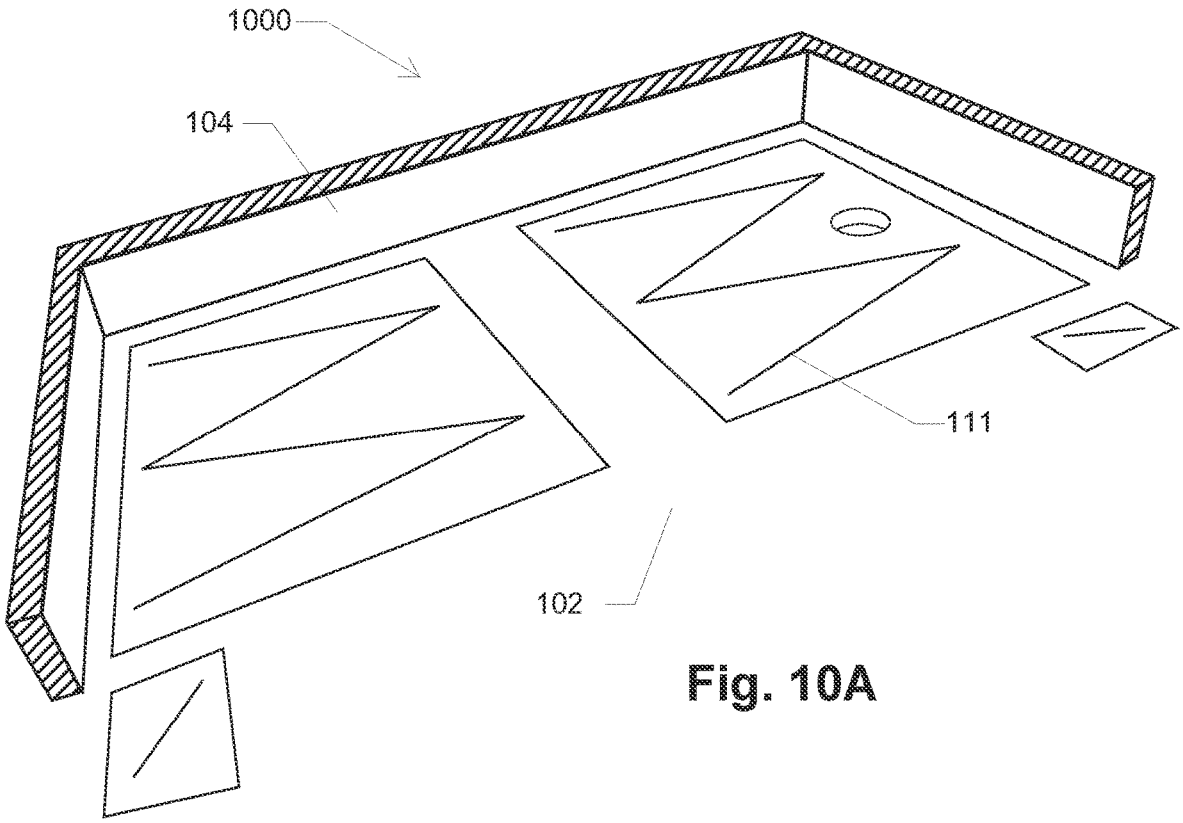
FIGS. 10A, 10B, 10C, 10D, 10E, 10F, and 10G illustrate another example installation of an underlayment layer of flooring using fiber boards as a bathtub binder.
Figure 10B:
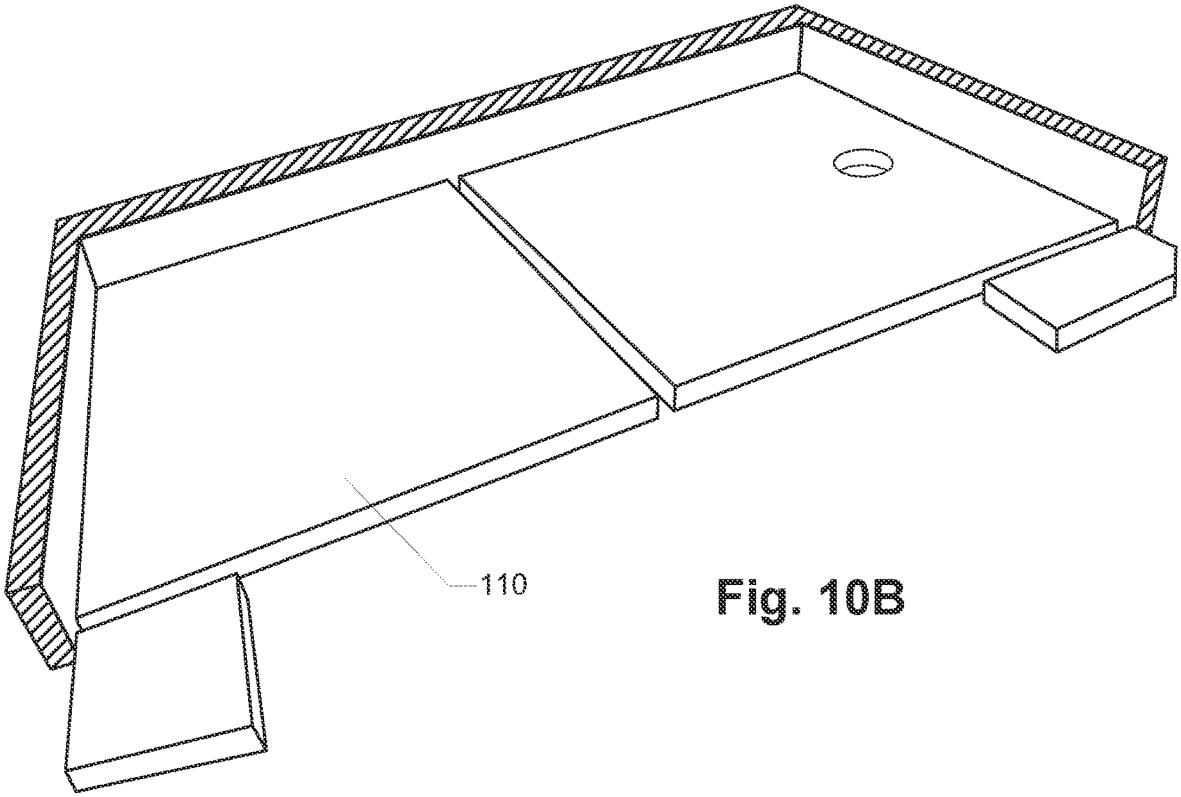
Figure 10C:
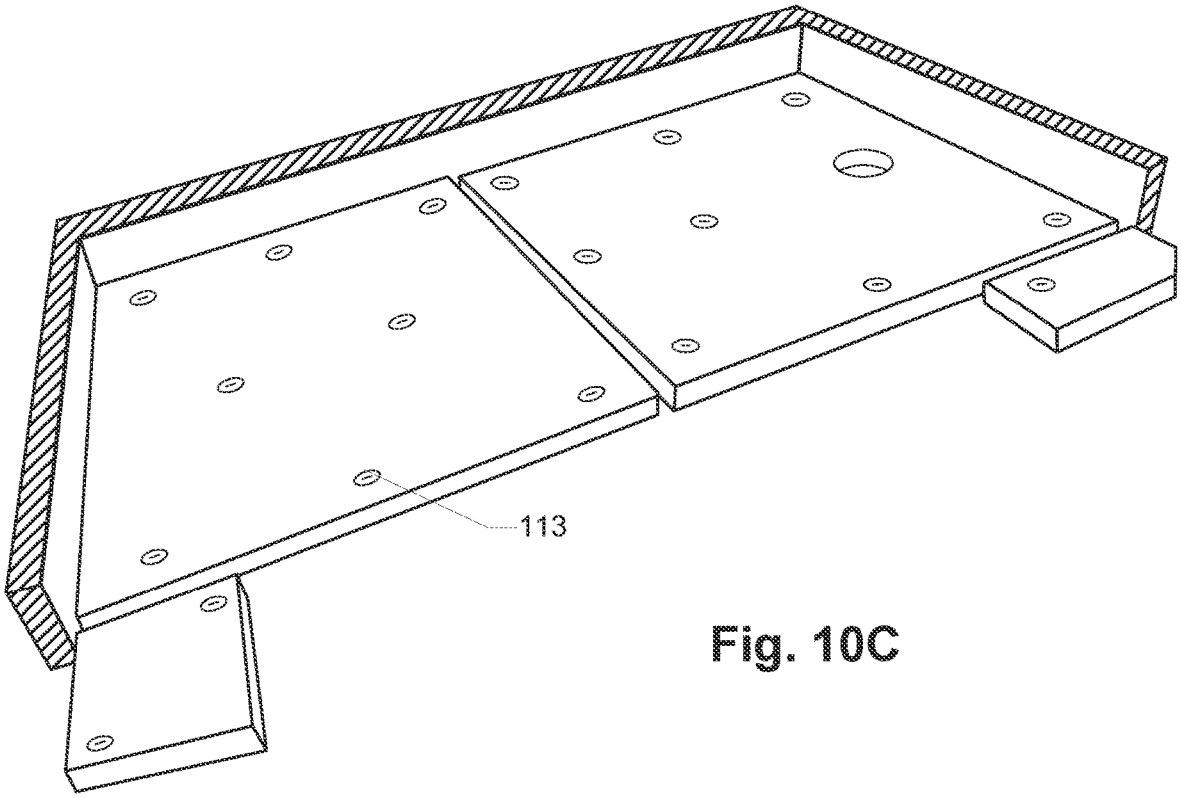
Figure 10D:
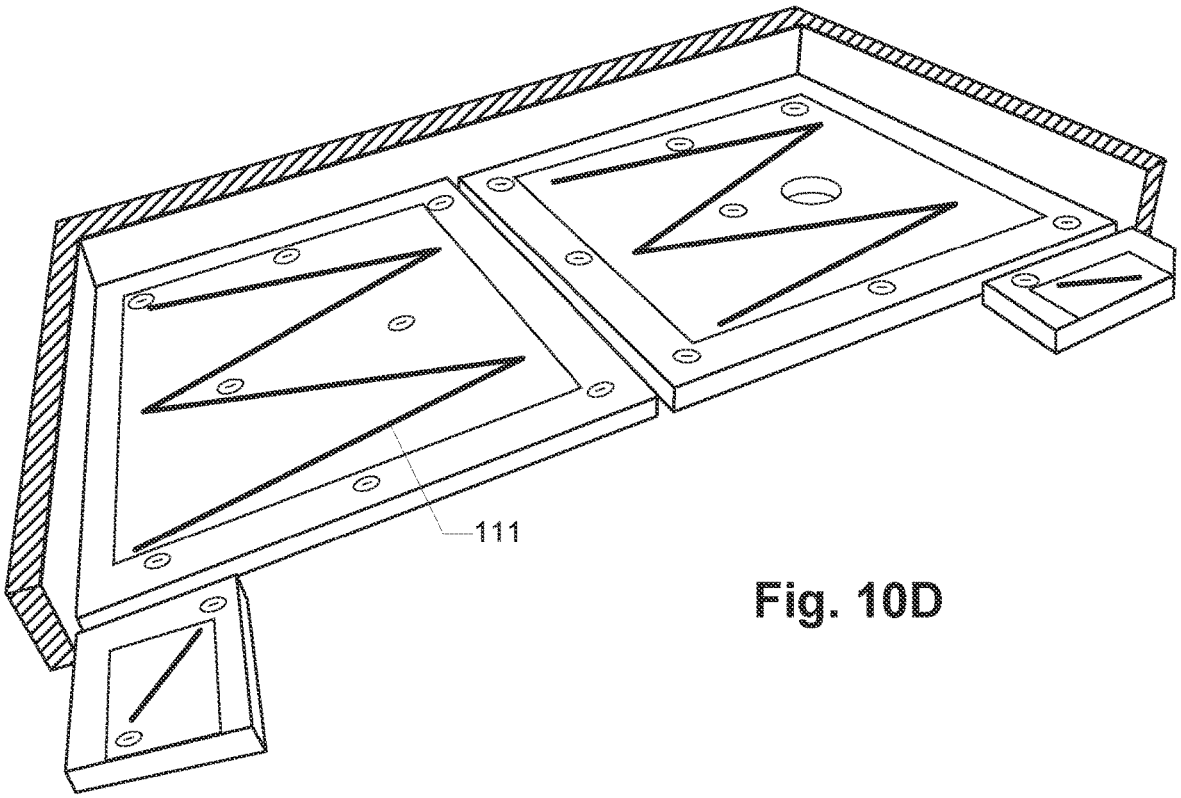
Figure 10E:
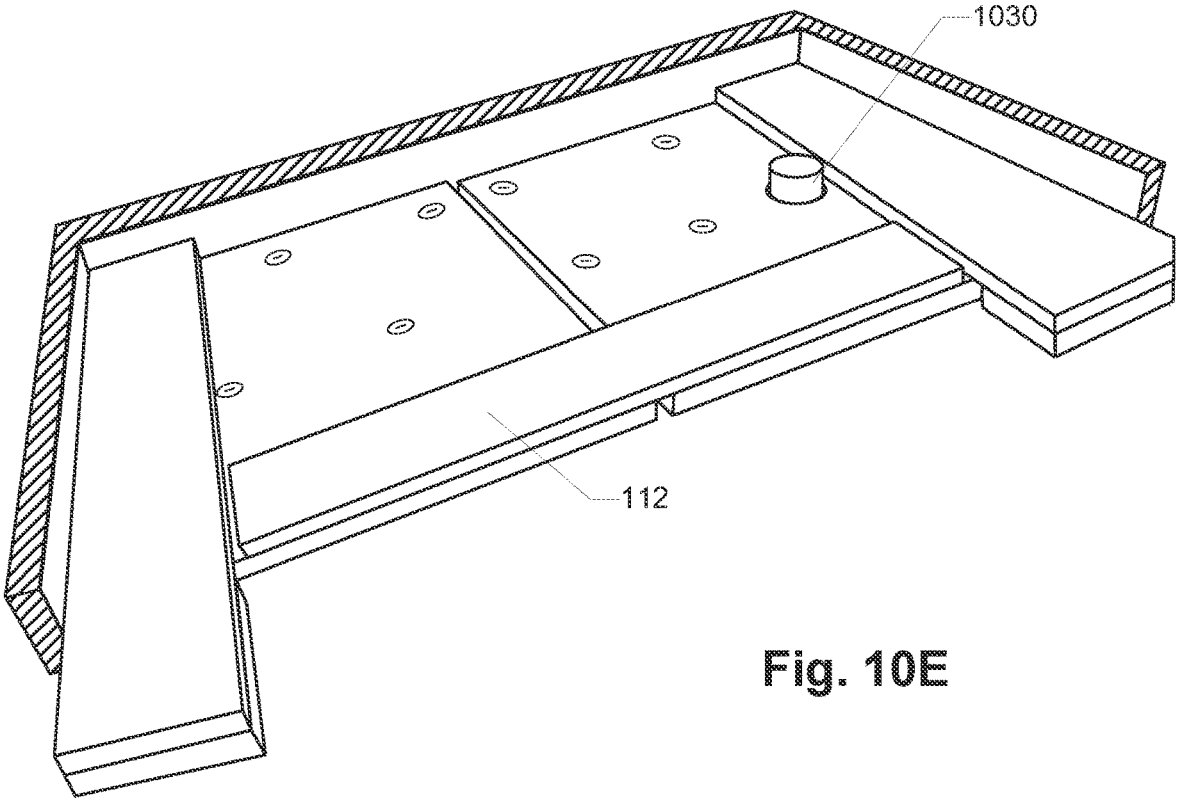
Figure 10F:
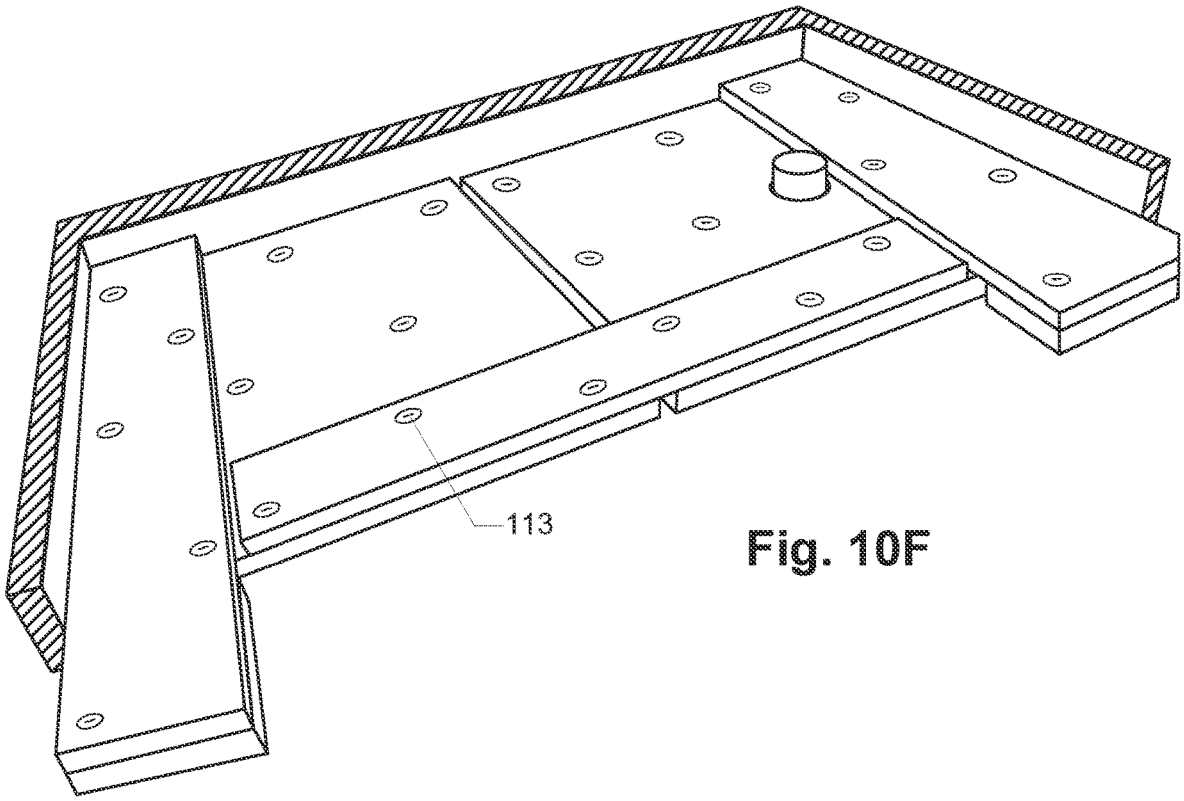

FIG. 10A illustrates application of the adhesive 111 to the subfloor 102. FIG. 10B illustrates installation of the isolation boards 110 on the subfloor 102. FIG. 10C illustrates using mechanical fasteners 113 to secure the isolation board 110 to the subfloor 102 to allow the adhesive 111 to dry. FIG. 10D illustrates application of the adhesive 111 to a topside of the isolation boards 110. FIG. 10E illustrates installation of the structural boards 112 on top of the isolation boards 110 so that they are offset horizontally from one another. FIG. 10F illustrates using mechanical fasteners 113 to secure the structural boards 112 to the isolation boards 110 to allow the adhesive 111 to dry.

Figure 10G:
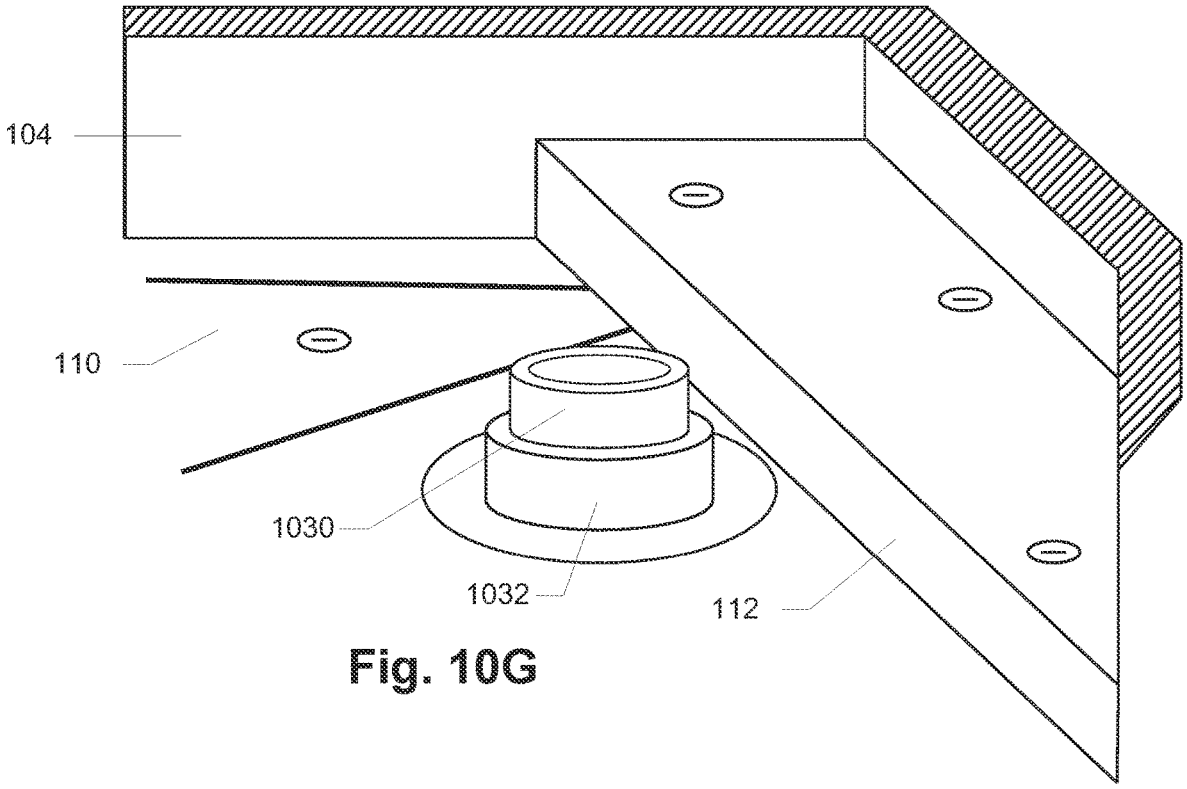

FIG. 10G illustrates a pipe penetration for the bathtub to be installed over the isolation boards 110. The pipe 1030 penetrates through the isolation boards 110 and the subfloor 102. The pipe 1030 includes foam insulation 1032 or fire-rated caulking 1032 between the pipe 1030 and the isolation boards 110, similar to the embodiment described herein with reference to FIG. 3B.

FIGS. 11A, 11B, 11C, 11D, and 11E illustrate another example installation of an underlayment layer 1100 of flooring using fiber boards as a bedroom closet binder. The installation follows the same installation steps described herein with reference to FIGS. 2A-2F with one or more installation steps removed for the sake of brevity. The installation differs from that described with reference to FIGS. 2A-2F because it is for a different portion of a building (e.g., the flooring in a non-walk-in closet rather than a perimeter binder).

Figure 11A:
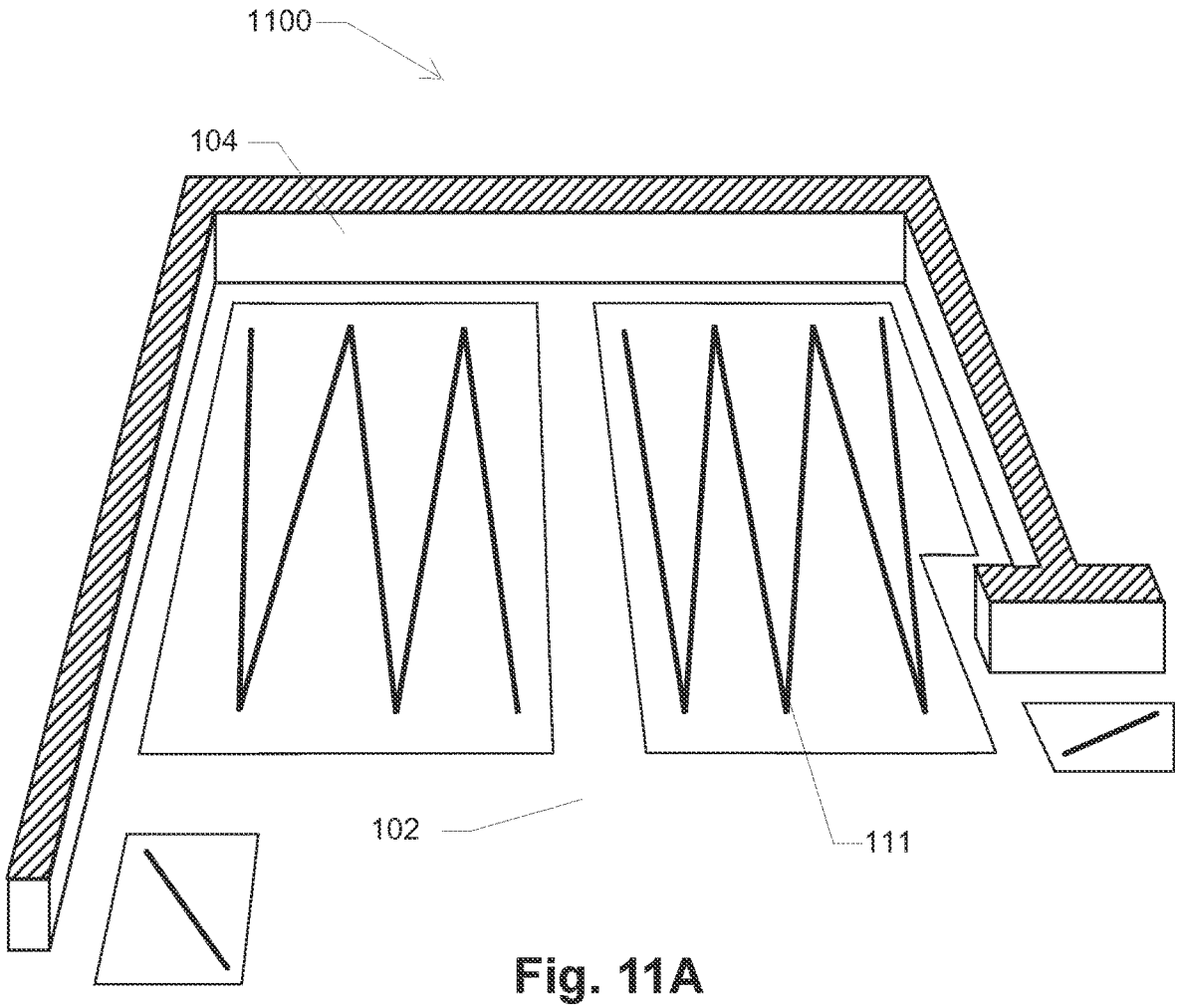
FIGS. 11A, 11B, 11C, 11D, and 11E illustrate another example installation of an underlayment layer of flooring using fiber boards as a bedroom closet binder.
Figure 11B:
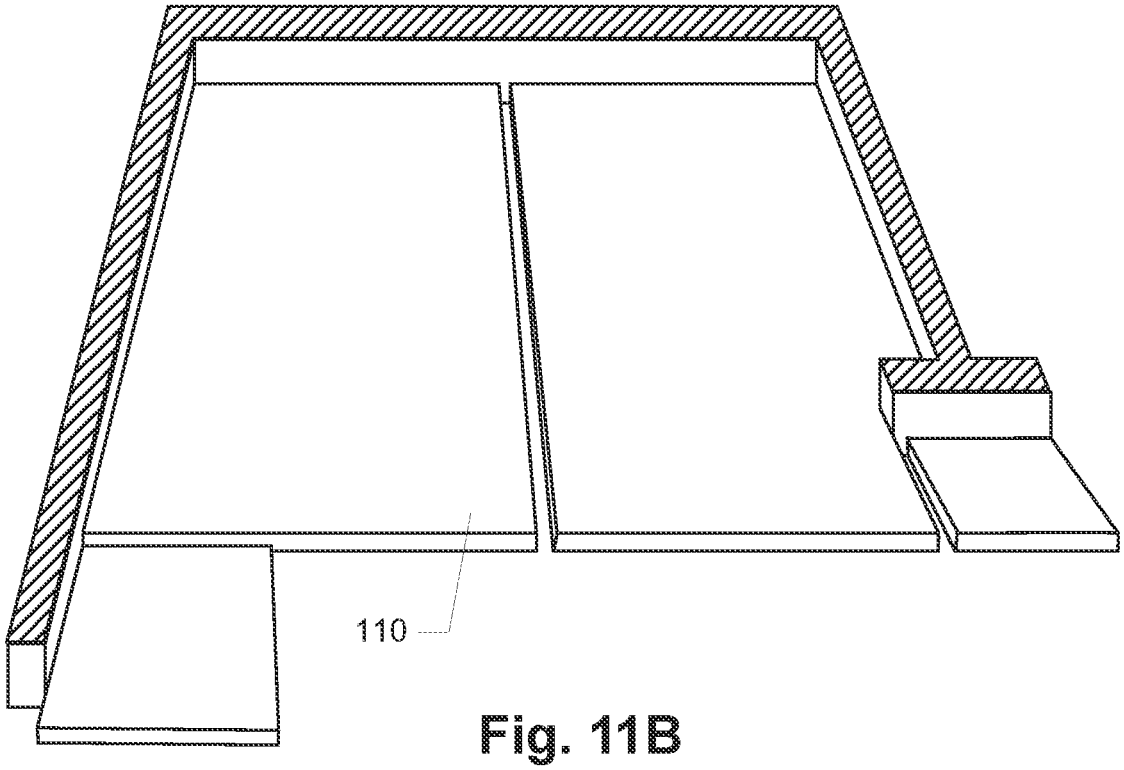
Figure 11C:
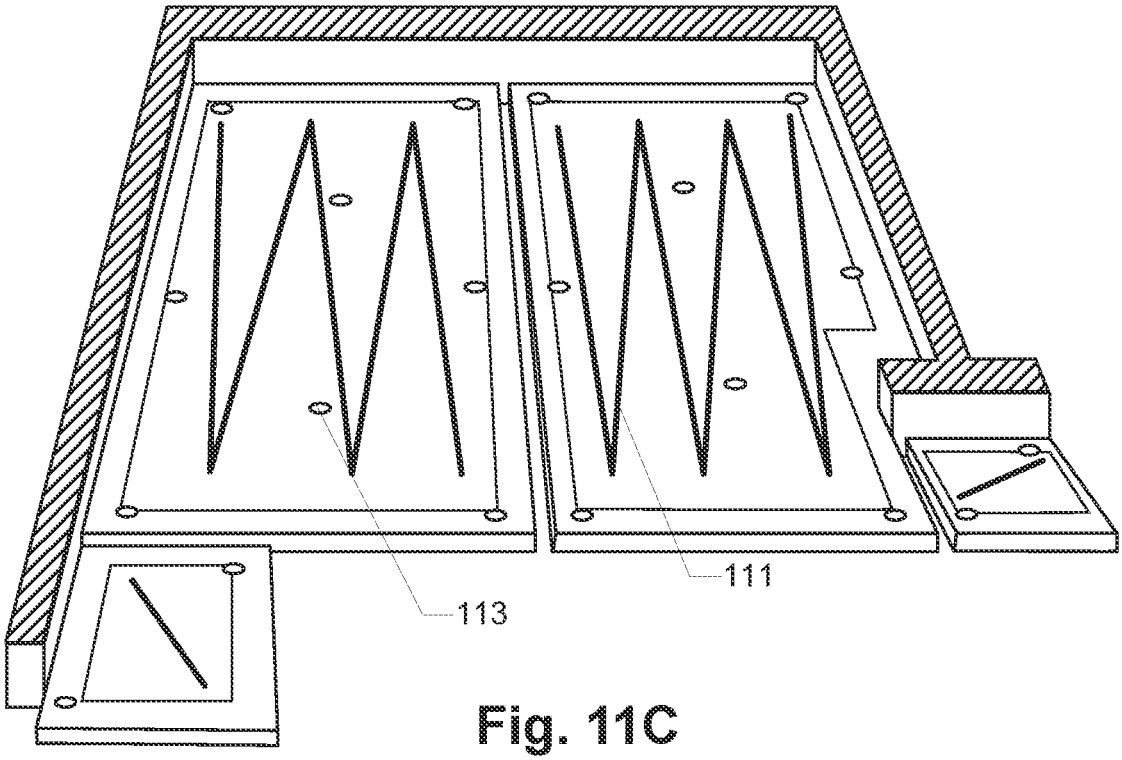
Figure 11D:
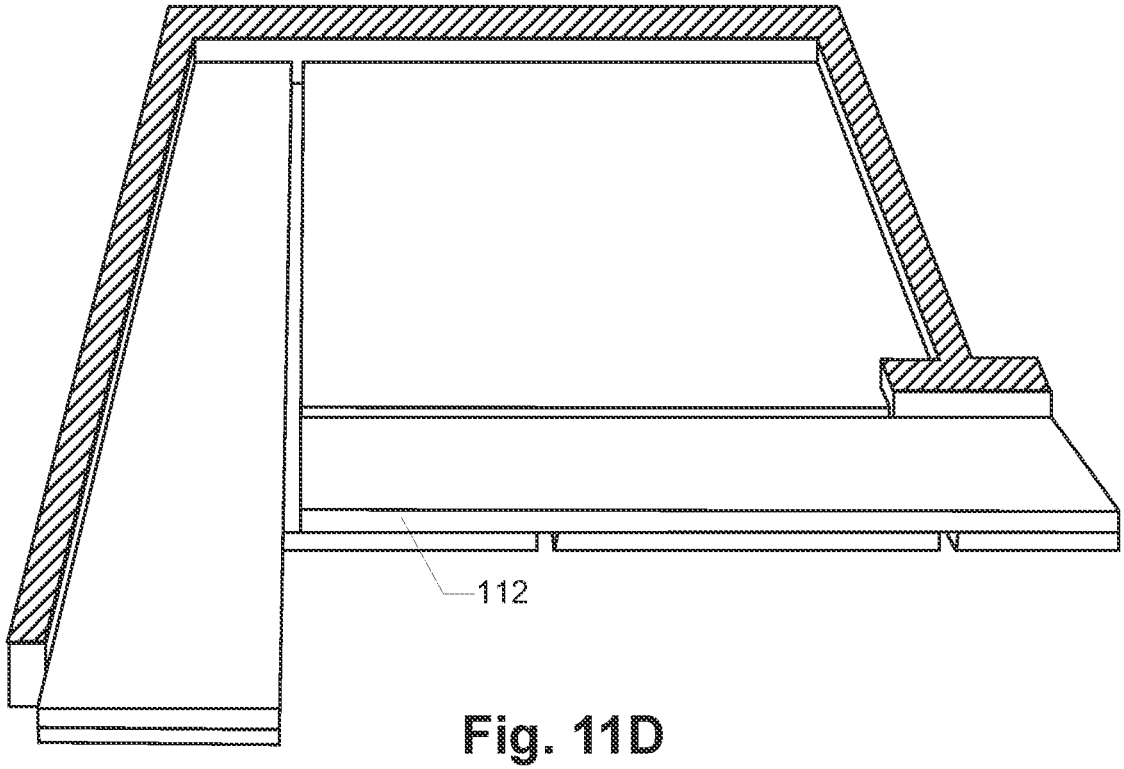
Figure 11E:
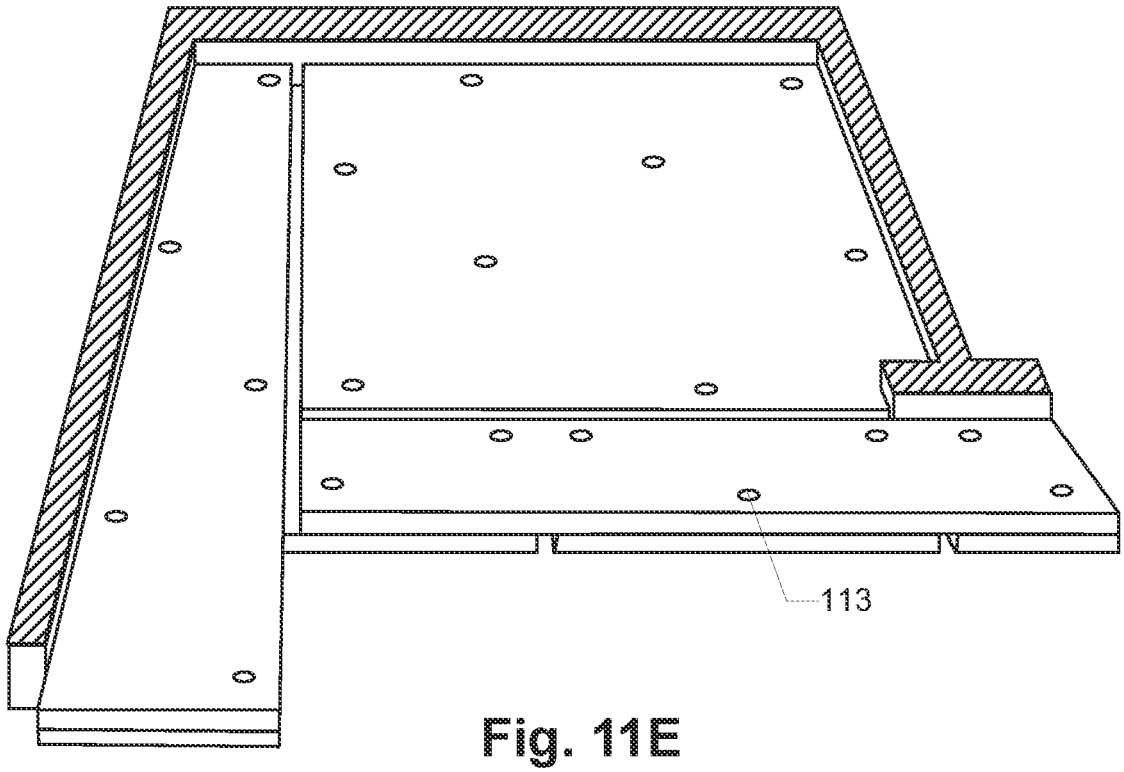

FIG. 11A illustrates application of the adhesive 111 to the subfloor 102. FIG. 11B illustrates installation of the isolation boards 110 on the subfloor 102. FIG. 11C illustrates application of the adhesive 111 to a topside of the isolation boards 110. FIG. 11D illustrates installation of the structural boards 112 on top of the isolation boards 110 so that they are offset horizontally from one another. FIG. 11E illustrates using mechanical fasteners 113 to secure the structural boards 112 to the isolation boards 110 to allow the adhesive 111 to dry.

FIGS. 12A, 12B, 12C, 12D, 12E, and 12F illustrate another example installation of an underlayment layer 1200 of flooring using fiber boards as a kitchen island binder. The installation follows the same installation steps described herein with reference to FIGS. 2A-2F but are for a different portion of a building (e.g., underneath a kitchen island or cabinets in a finished building rather than a perimeter binder).

Figure 12A:
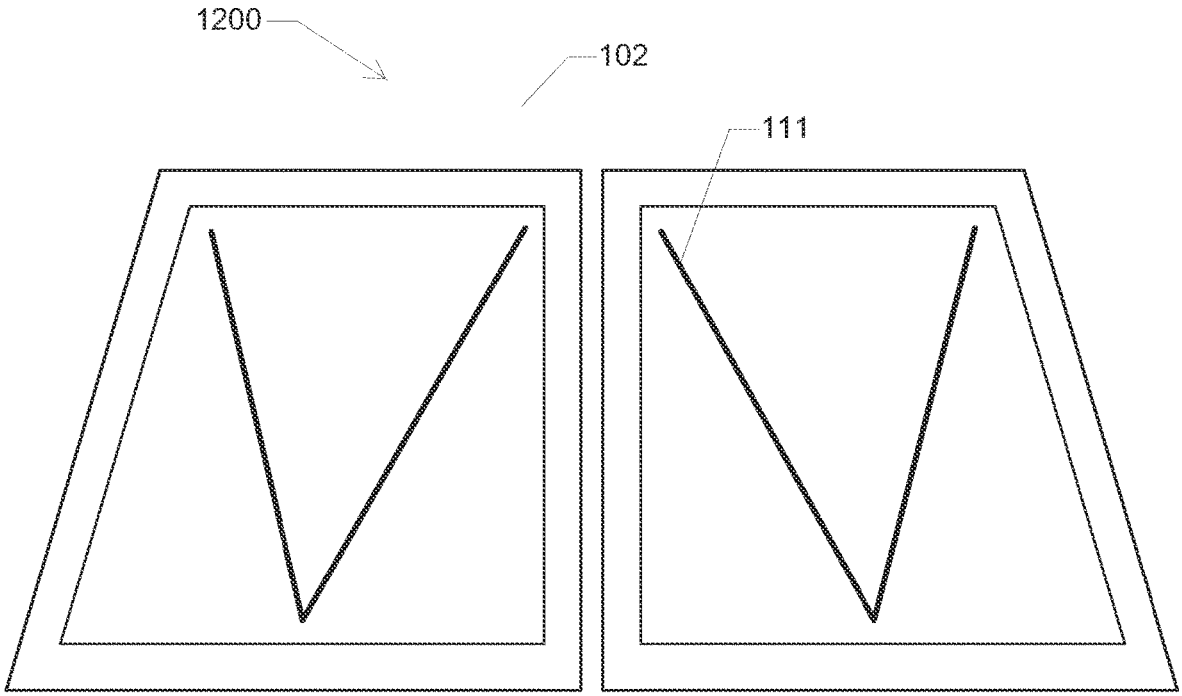
FIGS. 12A, 12B, 12C, 12D, 12E, and 12F illustrate another example installation of an underlayment layer of flooring using fiber boards as a kitchen island binder.
Figure 12B:
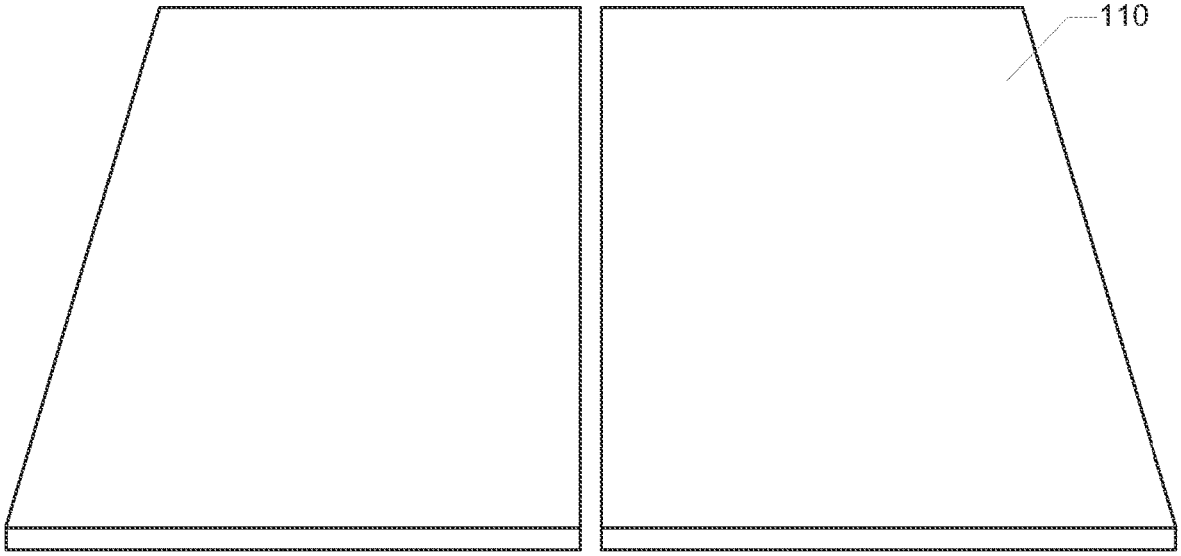
Figure 12C:
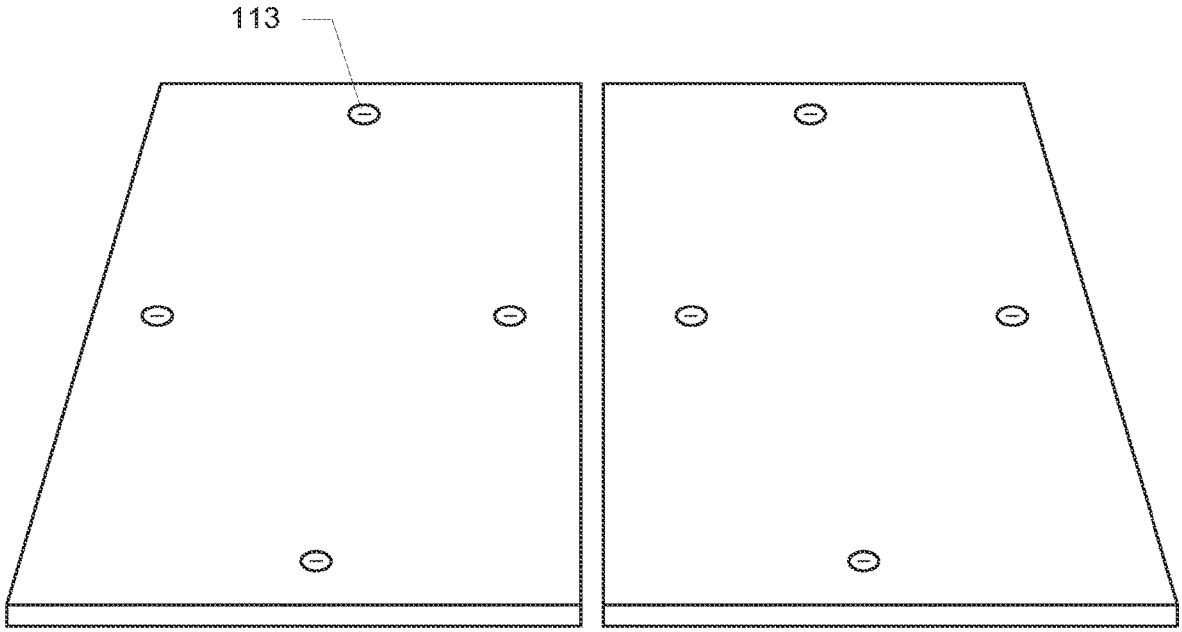
Figure 12D:
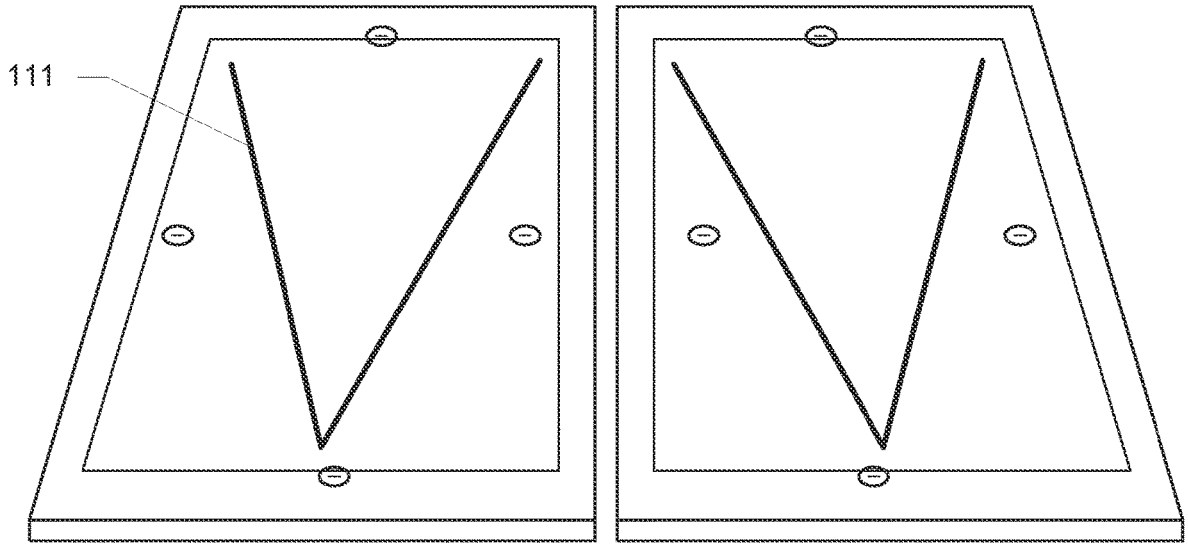
Figure 12E:
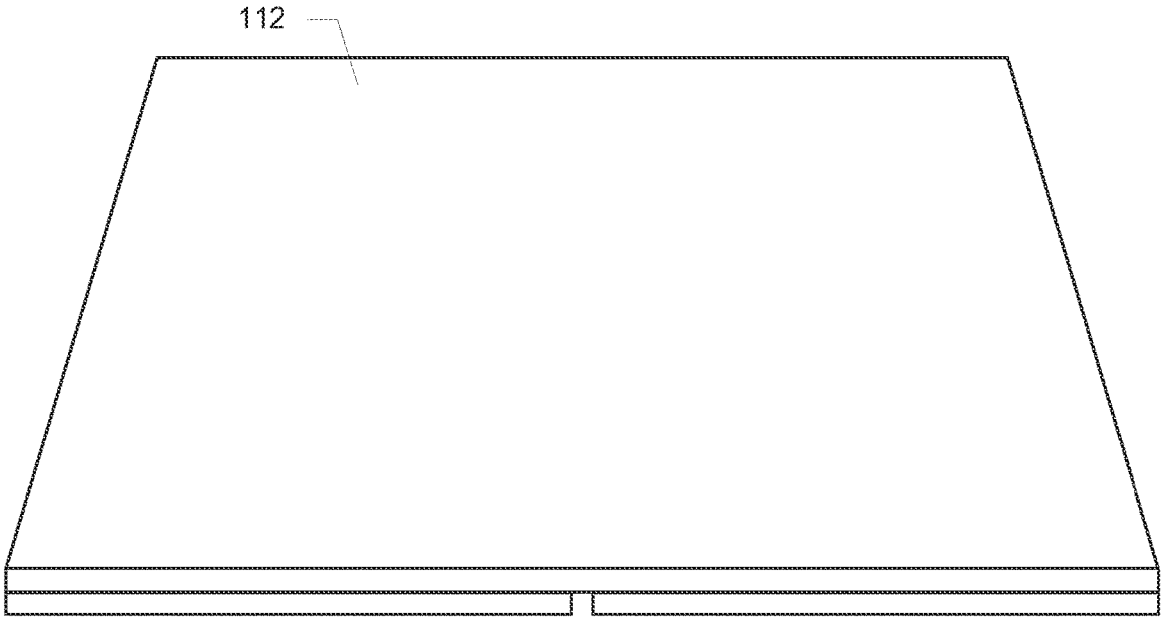
Figure 12F:
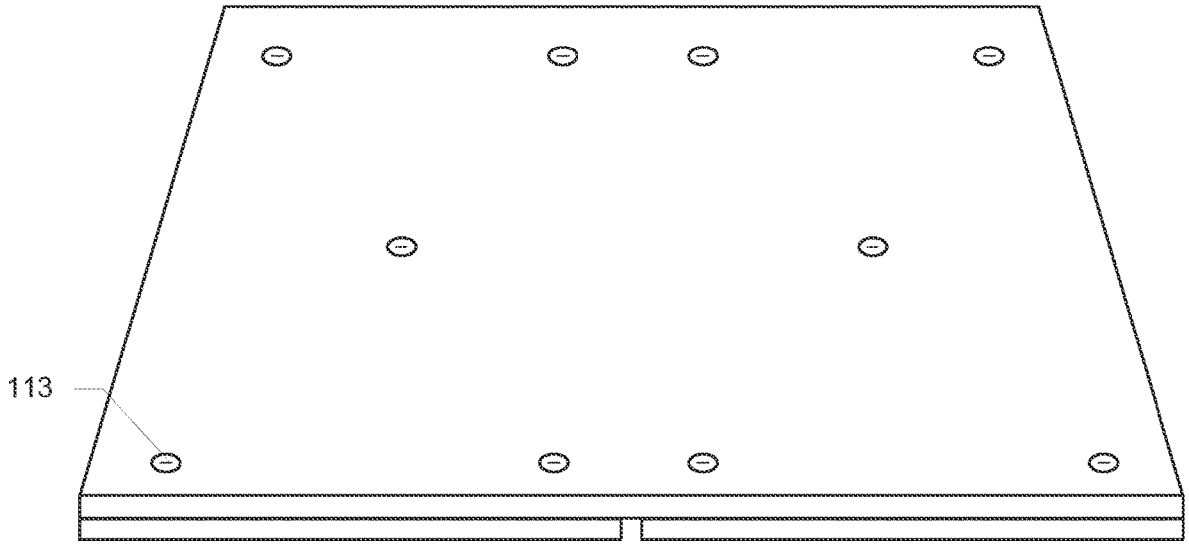

FIG. 12A illustrates application of the adhesive 111 to the subfloor 102. FIG. 12B illustrates installation of the isolation boards 110 on the subfloor 102. FIG. 12C illustrates using mechanical fasteners 113 to secure the isolation board 110 to the subfloor 102 to allow the adhesive 111 to dry. FIG. 12D illustrates application of the adhesive 111 to a topside of the isolation boards 110. FIG. 12E illustrates installation of the structural boards 112 on top of the isolation boards 110 so that they are offset horizontally from one another. FIG. 12F illustrates using mechanical fasteners 113 to secure the structural boards 112 to the isolation boards 110 to allow the adhesive 111 to dry.

FIGS. 13A, 13B, 13C, 13D, and 13E illustrate a plan view of an installation of an underlayment layer 1300 of flooring in a dwelling. The dwelling is a studio-style apartment, but the disclosed installation steps can be applied to various other building and dwelling types. The installation follows the same installation steps described herein with reference to FIGS. 2A-2F but includes all of the disclosed binders rather than just a perimeter binder.

The disclosed installation in FIGS. 13A-13E illustrates that a first portion of the subfloor 102 which is configured to receive the isolation boards 110 can be divided among different rooms and need not be a continuous area. For example, disjointed first portions can be installed for a kitchen island. In addition, it can be seen that the first portion can include the prone areas of the dwelling so that isolation boards 110 and structural boards 112 are installed around the interior perimeter of each room and for other non-critical areas such as kitchen islands, cabinets, underneath bathtubs, in closets, and the like. Thus, the subfloor 102 of a dwelling is typically divided among various rooms, and, particularly in a multi-family dwelling, can have multiple pre-pour, or first portion areas of the subfloor 102.

Figure 13A:
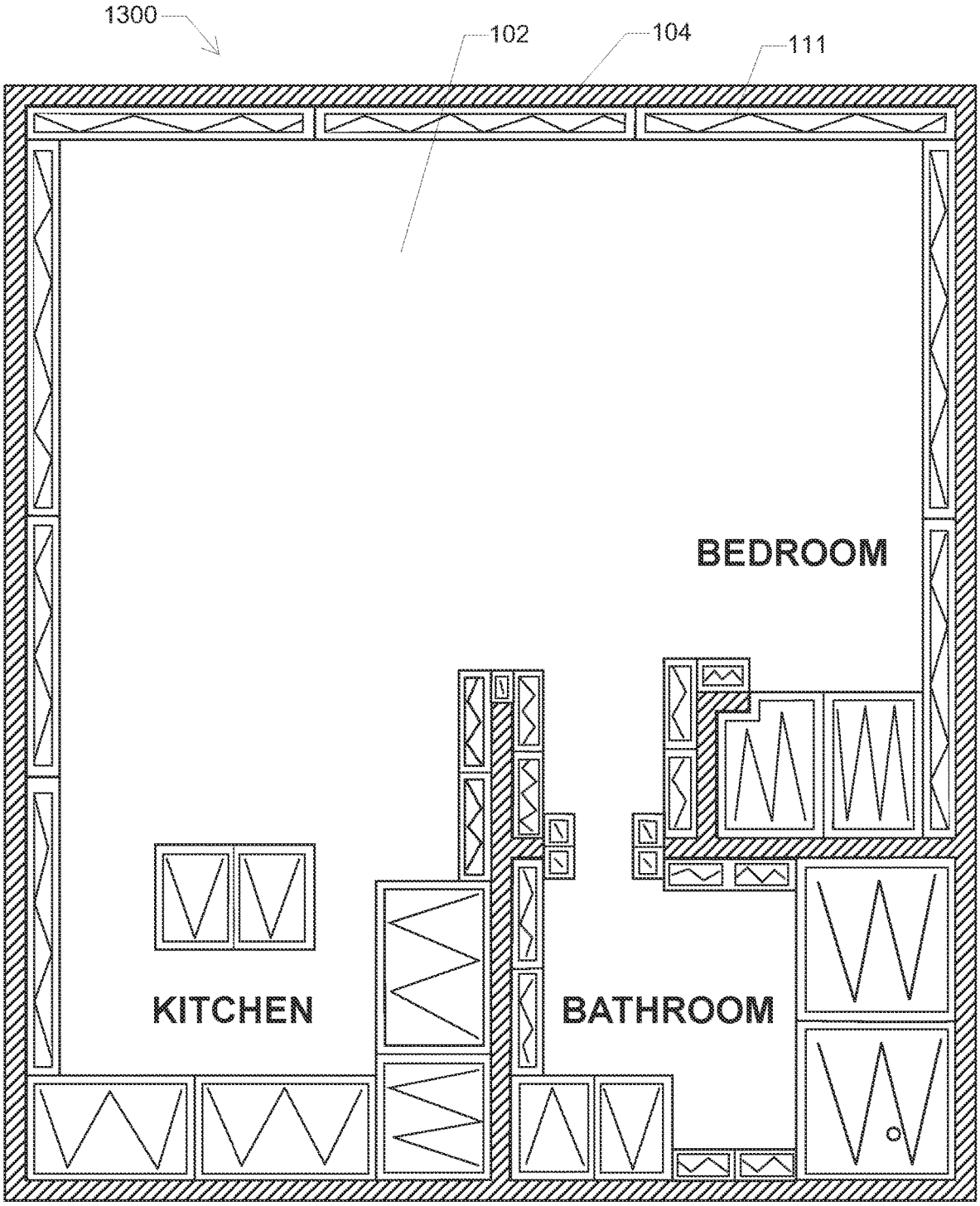
FIGS. 13A, 13B, 13C, 13D, and 13E illustrate a plan view of an installation of an underlayment layer of flooring in a dwelling.
Figure 13B:
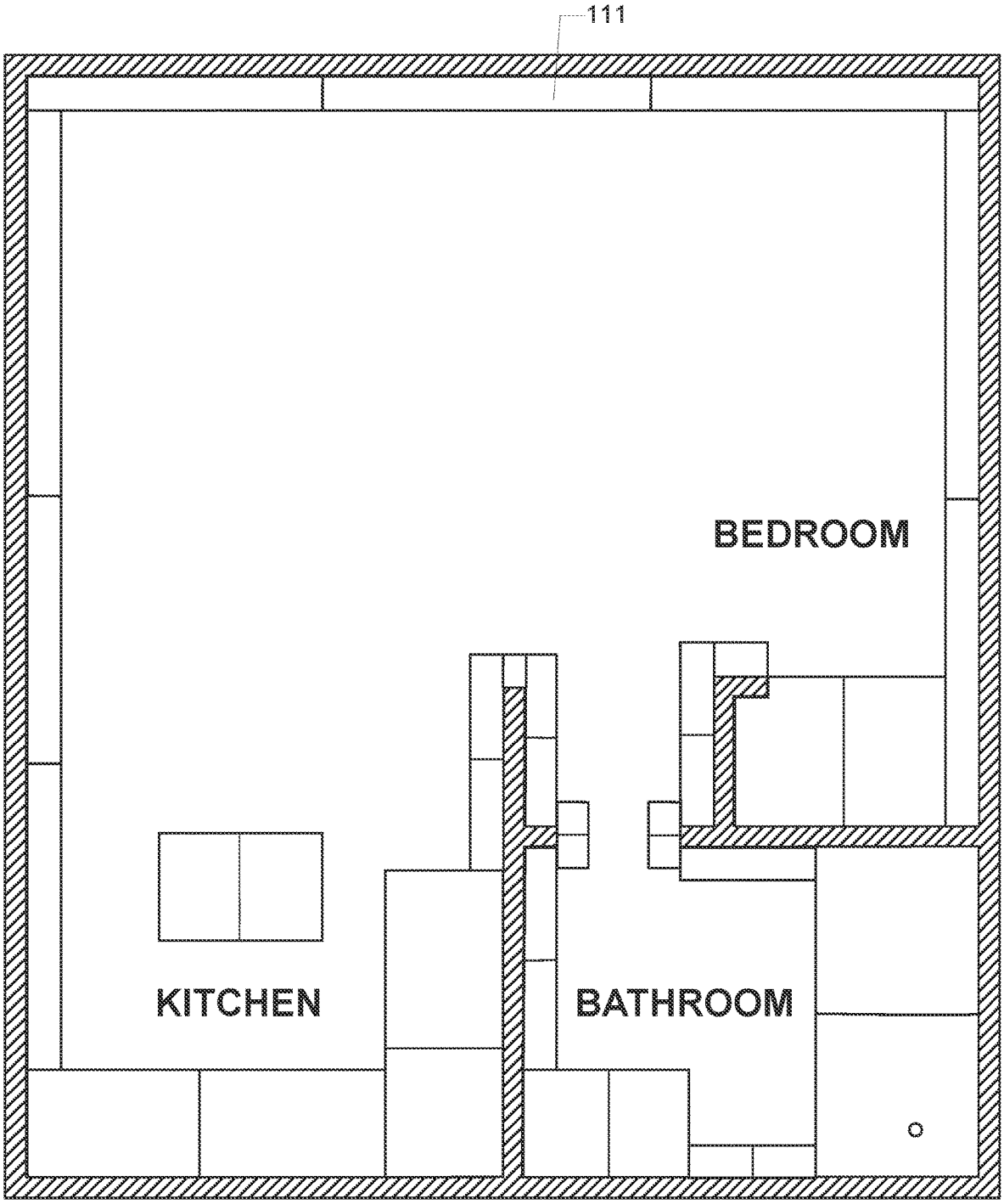
Figure 13C:
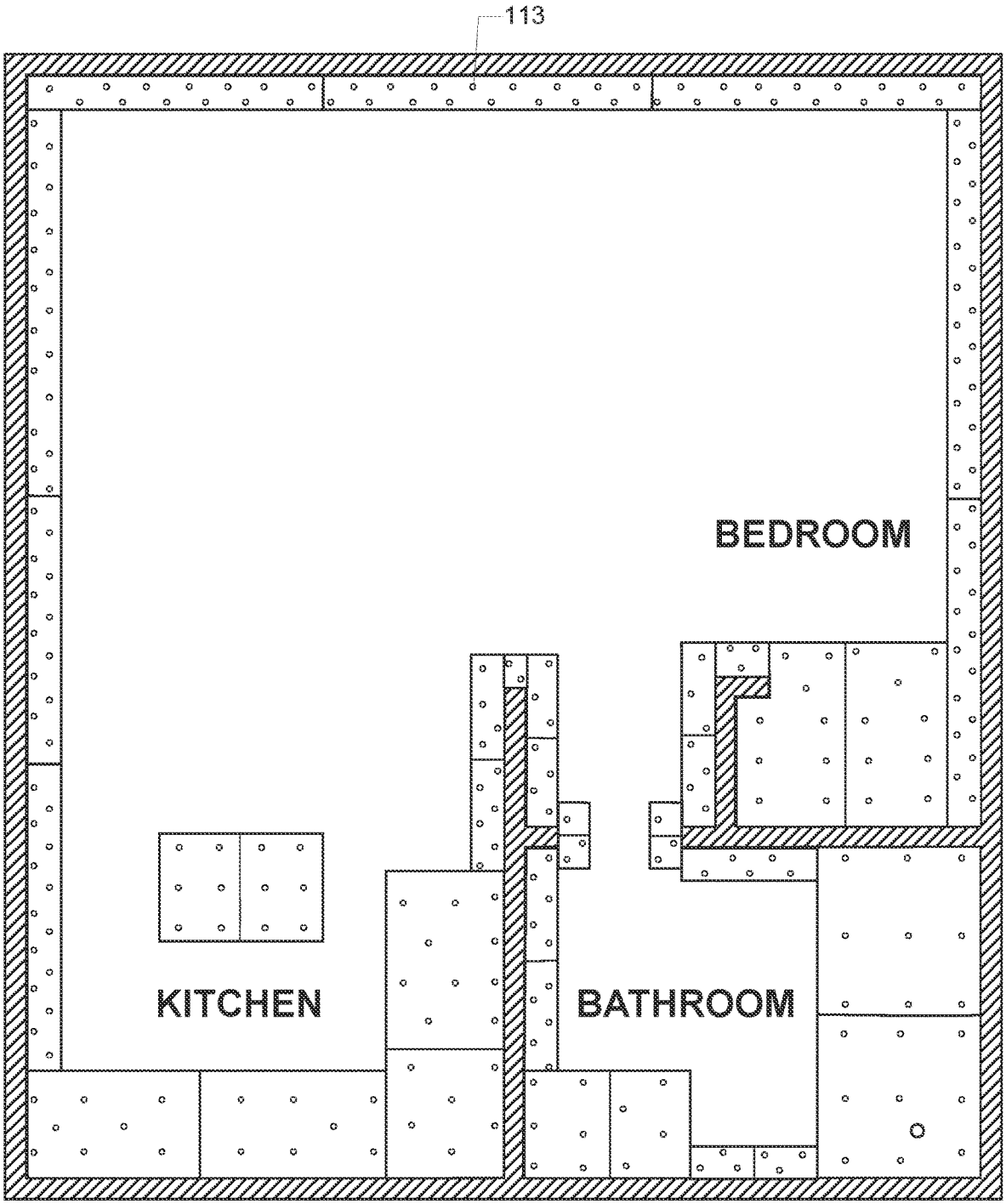
Figure 13D:
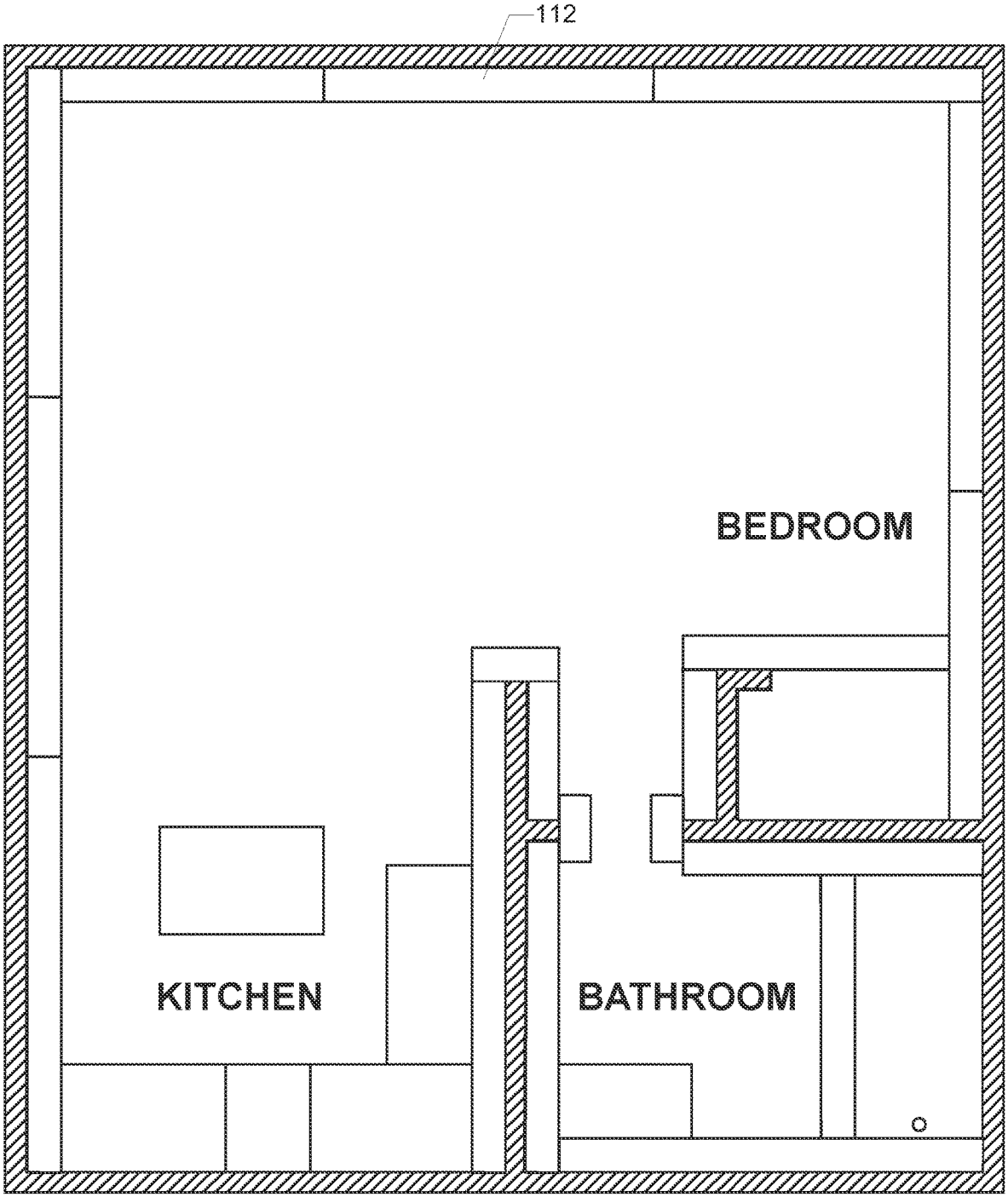
Figure 13E:
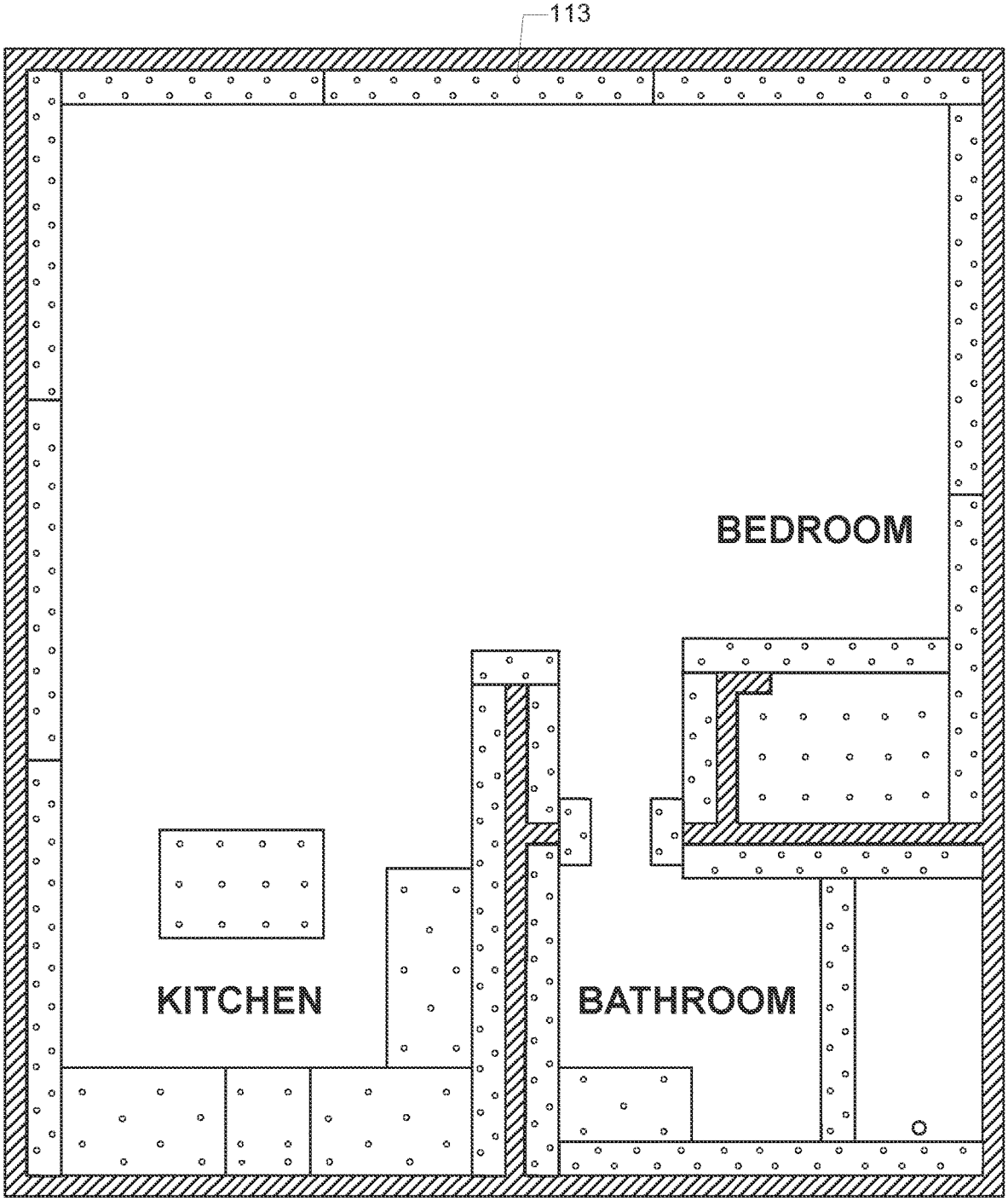

FIG. 13A illustrates application of the adhesive 111 to the subfloor 102. FIG. 13B illustrates installation of the isolation boards 110 on the subfloor 102. FIG. 13C illustrates using mechanical fasteners 113 to secure the isolation boards 110 to the subfloor 102 to allow the adhesive 111 to dry. FIG. 13D illustrates installation of the structural boards 112 on top of the isolation boards 110 so that they are offset horizontally from one another. FIG. 13E illustrates using mechanical fasteners 113 to secure the structural boards 112 to the isolation boards 110 to allow the adhesive 111 to dry.

Example Hybrid Underlayment Installation Methods

Figure 14:
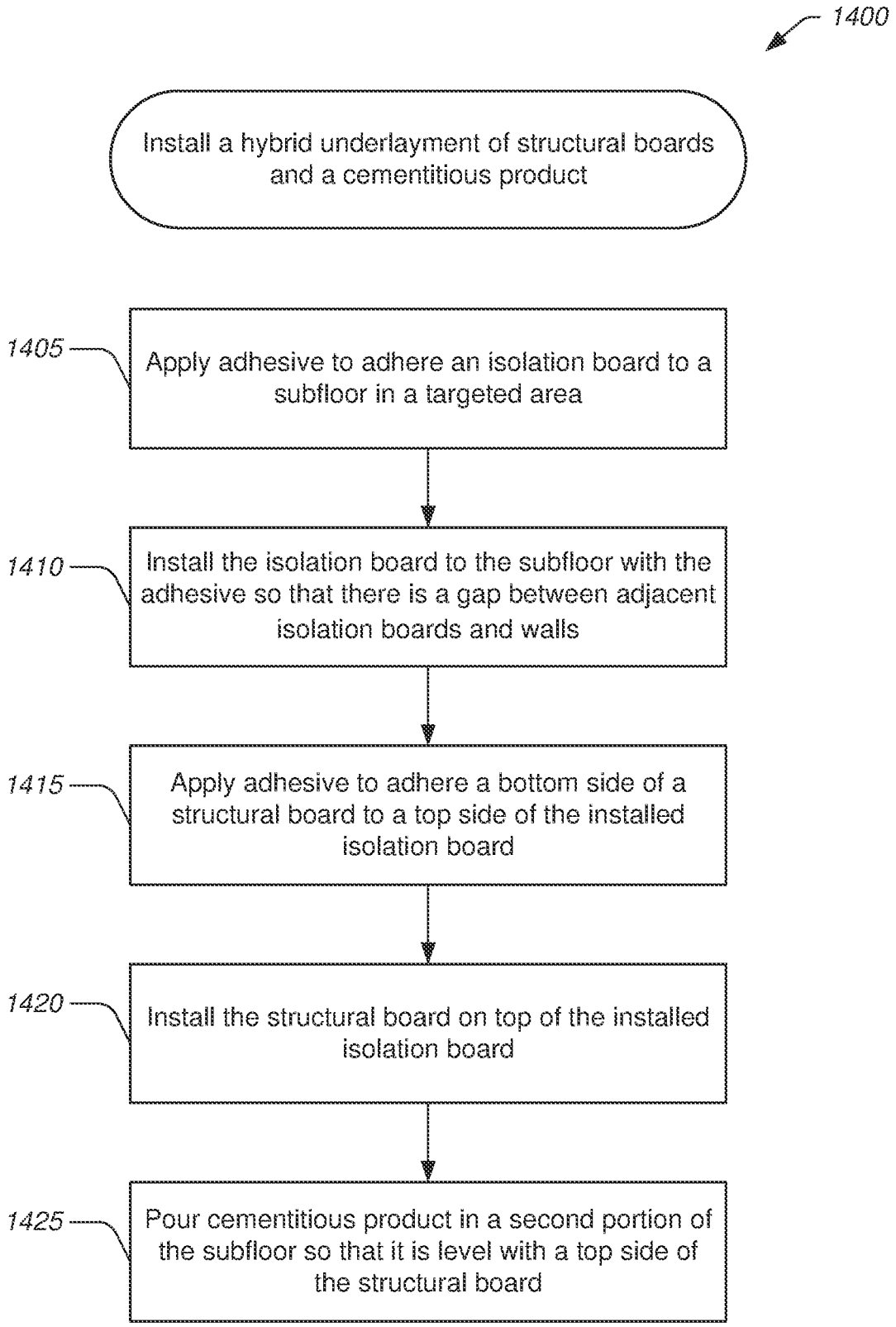
FIG. 14 illustrates a flow chart of an example method for installing a hybrid underlayment of structural boards and a cementitious product.

FIG. 14 illustrates a flow chart of an example method 1400 for installing a hybrid underlayment of fiber boards and a cementitious product. The fiber boards and cementitious product have been described elsewhere herein, so further description of these items will be omitted here for conciseness in the description.

Prior to installing the underlayment layer, a worker can ensure the installation area is swept and clean of debris throughout corners and center. The substrate (e.g., subfloor) can be inspected for delamination and excessive sagging prior to installation of the underlayment. In addition, the worker can confirm the overall thickness of the underlayment, and specifically the targeted thickness of the cementitious product. The structural barrier formed by the isolation board in combination with one or more structural boards should be configured to achieve the targeted thickness of the cementitious product. The isolation board and/or the structural boards are fire-rated and/or sound-rated. The worker may also measure wall length or targeted length and pre-cut the structural boards and/or the isolation boards to the measured length. In addition, the worker may place the isolation board on top of the subfloor, pushing firmly against wall to evaluate and to confirm panel placement.

In block 1405, a worker applies adhesive to adhere an isolation board to the subfloor in a targeted area. The targeted area is located within a first portion of the subfloor where the cementitious product will not be poured. The adhesive can be applied to the subfloor, to an underside of the isolation board, or to both. The worker can apply a pattern of adhesive to the subfloor and/or to the underside of the isolation board.

In block 1410, the worker installs the isolation board to the subfloor with the adhesive so that there is a gap between adjacent isolation boards and any walls. The worker can press the isolation board in place to secure it to the subfloor with the adhesive. This step can be repeated as necessary to obtain targeted coverage with the isolation boards to complete a first installation layer. This step can be repeated for the first layer by installing a plurality of installation boards edge-to-edge to cover the first portion of the subfloor.

In addition, a worker may secure the first layer of isolation board to the subfloor using mechanical fasteners such as nails. Nails can be installed using a linear pattern about 8 inches to about 10 inches apart and about ½ inch from the edge of the isolation board with a ⅛-inch countersink to create an even distribution of pressure and to allow the second layer to be properly placed without obstruction.

Once the first layer of isolation boards has been installed, a second layer can be installed (if necessary). Installation follows the same pattern, but nails are offset from nails in first layer. For example, in block 1415, adhesive is applied to adhere a bottom side of the structural boards to a top side of the installed installation boards. In block 1420, a worker installs the structural board on top of the installed isolation boards. Gaps between boards can be aligned vertically or they can be offset. This completes a second layer of the fiberboard installation, covering the first portion of the subfloor. This process can be repeated to build up a targeted thickness that matches the targeted thickness of the cementitious product pour. The first portion of the subfloor can include areas such as cabinets, closets, bathtubs, areas near walls and/or other dead spaces are to be set. In some embodiments, the worker can place caulking and/or isolating foam at all pipe penetrations or other penetrations.

In block 1425, the worker pours cementitious product in a second portion of the subfloor so that it is level with a top side of the uppermost structural board. This is done to create an even and level underlayment. The method 1400 may also include applying sealant to seams between the combined fiberboards and the cementitious product. This can be done to enhance the levelness of the underlayment. In some instances, a sound mat may be laid over the second portion of the subfloor prior to pouring the cementitious product. Once the flooring system has been installed using the method 1400, construction schedule may commence with installations such as drywall, cabinets, and trim as early as within 24 hours after the final pour.

Example Performance Metrics

The following includes tables summarizing testing results of various underlayment configurations. The tables indicate a hybrid underlayment system, as disclosed herein, enhances sound control over cementitious product or fiberboards alone.

The tests include (2) Normalized Noise Isolation Class (NNIC) and ten (10) Normalized Impact Sound Rating (NISR) tests to evaluate the airborne and impact sound isolation of the floor ceiling assembly between units. The tests were performed in strict accordance with ASTM standard E336, "Standard Test Method for Measurement of Airborne Sound Attenuation between Rooms in Buildings" and ASTM standard E1007, "Standard Test Method for Field Measurement of Tapping Machine Impact Sound Transmission Through Floor-Ceiling Assemblies and Associated Support Structures". The tests also included the impact isolation class rating (IIC) based on ASTM testing protocol E492.90 and E989.89. Impact Insulation Class rating or IIC rating can be used by architects, builders and code authorities for acoustical design purposes in building construction. The greater the IIC rating, the lower the impact sound transmission through the floor-ceiling assembly. The sound transmission classification (STC) value was obtained using ASTM testing protocol E90-97 and E413-87. Low Frequency Impact Rating (LIR), which defines the thudding on a floor. High Frequency Impact Rating (NHIR), which defined the high frequency impact isolation (like high heels, animal nails, etc. on the floor). Both of these are important in defining acoustical performance.

Results based on floor-ceiling testing are shown in Table 1.

TABLE 1

| Test Specimen | NNIC | NISR | LIR | NHIR |
|---|---|---|---|---|
| Living Room to Garage (hybrid system, 6" perimeter) | — | 40 | 51 | 39 |
| Kitchen to Garage (hybrid system, fiberboards under cabinet areas) | — | 45 | 42 | 45 |
| Bedroom 3 to Garage (gypsum concrete) | — | 42 | 53 | 41 |
| Bedroom 3 closet to garage (fiberboard) | — | 43 | 52 | 54 |
| Bedroom 1 to Garage (gypsum concrete) | — | 40 | 60 | 39 |
| Bedroom 1 closet to garage (fiberboard) | — | 46 | 59 | 60 |
| Master Bedroom to Garage (gypsum concrete) | — | 39 | 47 | 38 |
| Master Bedroom to Garage (fiberboard) | — | 42 | 55 | 53 |
| Bedroom 3 to Garage (gypsum concrete area only) | — | 44 | 49 | 43 |
| Bedroom 3 to Garage (fiberboard area only) | — | 42 | 59 | 51 |
| Living room and kitchen to garage (gypsum concrete) | 39 | — | — | — |
| Bedrooms Area (hybrid system) | 42 | — | — | — |

Three subfloor systems were tested over a wood structure with a direct attached ceiling and batt insulation in the stud cavities. The systems were: 1" thick gypsum concrete throughout, 1" thick gypsum concrete with a border of fiberboards (i.e., the hybrid underlayment described herein), and fiberboards alone. Floor finishes were not installed at the time of the test. The average impact ratings for each subfloor system are summarized in Table 2.

TABLE 2

| System | Average NISR | Average LIR | Average NHIR |
|---|---|---|---|
| Gypsum concrete | 41 | 51 | 41 |
| Gypsum concrete with fiberboard | 43 | 47 | 42 |
| Fiberboard | 43 | 56 | 54 |

The testing revealed similar performance between the gypsum concrete system and the hybrid system. The hybrid system (primarily in closets and under tubs) was found be significantly better at reducing high frequency impact sounds. The NHIR rating of the fiberboards alone was 13 points better than the gypsum concrete system, which is related to the material properties associated with the fiberboards that damp the high frequency sounds, which is not accomplished by gypsum concrete; which is expected. The fiberboards show an increase (amplification) in sound levels between 100 and 400 Hz, but this did not affect the ratings and is also expected from these systems.

Terminology and Additional Embodiments

The present disclosure describes various features, no single one of which is solely responsible for the benefits described herein. It will be understood that various features described herein may be combined, modified, or omitted, as would be apparent to one of ordinary skill. Other combinations and sub-combinations than those specifically described herein will be apparent to one of ordinary skill, and are intended to form a part of this disclosure. Various methods are described herein in connection with various flowchart steps and/or phases. It will be understood that in many cases, certain steps and/or phases may be combined together such that multiple steps and/or phases shown in the flowcharts can be performed as a single step and/or phase. Also, certain steps and/or phases can be broken into additional sub-components to be performed separately. In some instances, the order of the steps and/or phases can be rearranged and certain steps and/or phases may be omitted entirely. Also, the methods described herein are to be understood to be open-ended, such that additional steps and/or phases to those shown and described herein can also be performed.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." The word "coupled", as generally used herein, refers to two or more elements that may be either directly connected, or connected by way of one or more intermediate elements. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or" in reference to a list of two or more items, that word covers all of the following interpretations of the word: any of the items in the list, all of the items in the list, and any combination of the items in the list. The word "exemplary" is used exclusively herein to mean "serving as an example, instance, or illustration." Any implementation described herein as "exemplary" is not necessarily to be construed as preferred or advantageous over other implementations.

The disclosure is not intended to be limited to the implementations shown herein. Various modifications to the implementations described in this disclosure may be readily apparent to those skilled in the art, and the generic principles defined herein may be applied to other implementations without departing from the spirit or scope of this disclosure. The teachings of the invention provided herein can be applied to other methods and systems, and are not limited to the methods and systems described above, and elements and acts of the various embodiments described above can be combined to provide further embodiments. Accordingly, the novel methods and systems described herein may be embodied in a variety of other forms; furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure.

What is claimed is:

1. A flooring system having a hybrid underlayment, the flooring system comprising:

a plurality of isolation boards adhered to a subfloor in a targeted area, the targeted area lying within a first portion of the subfloor adjacent to a wall;

a cementitious product poured in a second portion of the subfloor so that the poured cementitious product is level with a top side of the plurality of isolation boards, the plurality of isolation boards defining a pour stop for the cementitious product; and a sealant applied on top of the poured cementitious product such that the sealant covers intersection locations between the poured cementitious product and the plurality of isolation boards;

wherein the plurality of isolation boards is comprised of water-resistant isolation boards, fire-rated cellulose fiberboards or combinations thereof.

2. The flooring system of claim 1, wherein the sealant is also applied on top of the plurality of isolation boards such that the sealant covers intersection locations between isolation boards.

3. The flooring system of claim 1, wherein the first portion of the subfloor is configured to lie beneath a bathtub.

4. The flooring system of claim 1, wherein the plurality of isolation boards comprise said water-resistant isolation boards.

5. The flooring system of claim 1, wherein the plurality of isolation boards comprise said fire-rated cellulose fiberboards.

6. The flooring system of claim 1, wherein a respective said combination includes one or more fire-rated cellulose fiberboards.

7. The flooring system of claim 1, wherein a respective said combination includes one or more water-resistant isolation boards.

8. The flooring system of claim 7, wherein the water-resistant isolation boards are configured to inhibit mold formation by inhibiting water from the poured cementitious product from entering individual water-resistant isolation boards.

9. The flooring system of claim 7, wherein the water-resistant isolation boards are configured to inhibit mold formation in the wall by preventing the poured cementitious product from contacting the wall.

10. The flooring system of claim 1 further comprising a component that penetrates through the subfloor within the first portion of the subfloor, wherein the plurality of isolation boards is adhered to the subfloor in such a way as to form a hole that permits the component to extend above the plurality of isolation boards.

11. The flooring system of claim 10 further comprising a caulking applied to a gap between the component and portions of the plurality of isolation boards that form the hole that permits the component to extend above the plurality of isolation boards.

12. The flooring system of claim 10, wherein the component comprises piping.

13. A method for installing a hybrid underlayment of a flooring system, the method comprising:

adhering a plurality of isolation boards to a subfloor in a targeted area, the targeted area lying within a first portion of the subfloor adjacent to a wall;

pouring cementitious product in a second portion of the subfloor so that the poured cementitious product is level with a top side of the isolation boards, the isolation boards defining a pour stop for the cementitious product; and applying a sealant on top of the poured cementitious product such that the sealant covers intersection locations between the poured cementitious product and the isolation boards;

wherein the plurality of isolation boards is comprised of water-resistant isolation boards, fire-rated cellulose fiberboards or combinations thereof.

14. The method of claim 13 further comprising applying a sealant on top of the isolation boards such that the sealant covers intersection locations between isolation boards.

15. The method of claim 13, wherein the first portion of the subfloor is configured to lie beneath a bathtub.

16. The method of claim 13, wherein the isolation boards comprise fire-rated cellulose fiberboards.

17. The method of claim 13, wherein the isolation boards comprise water-resistant isolation boards.

18. The method of claim 17, wherein the water-resistant isolation boards are configured to inhibit mold formation by inhibiting water from the poured cementitious product from entering individual water-resistant isolation boards.

19. The method of claim 17, wherein the water-resistant isolation boards are configured to inhibit mold formation in the wall by preventing the poured cementitious product from contacting the wall.

20. The method of claim 13, wherein:

the first portion of the subfloor includes a component that penetrates through the subfloor, and adhering the isolation boards to the subfloor includes adhering the isolation boards in such a way as to form a hole that permits the component to extend above the isolation boards.

21. The method of claim 20 further comprising applying caulking to a gap between the component and portions of the isolation boards that form the hole that permits the component to extend above the isolation boards.

22. The method of claim 20, wherein the component comprises piping.

* * * * *